US006575208B2

(12) United States Patent
Sharon et al.

(10) Patent No.: US 6,575,208 B2
(45) Date of Patent: Jun. 10, 2003

(54) METHOD AND APPARATUS FOR FILLING A MULTI-COMPARTMENT CONTAINER

(75) Inventors: Igal Sharon, Caesaria (IL); Michael Inbar, D.N. Shimkin (IL)

(73) Assignee: M.L.I.S. Projects Ltd., Tel Aviv (IL)

( * ) Notice: Subject to any disclaimer, the term of this patent is extended or adjusted under 35 U.S.C. 154(b) by 0 days.

(21) Appl. No.: 09/908,605

(22) Filed: Jul. 19, 2001

(65) Prior Publication Data

US 2001/0039977 A1 Nov. 15, 2001

Related U.S. Application Data

(63) Continuation-in-part of application No. 09/542,286, filed on Apr. 4, 2000.

(51) Int. Cl.[7] ..... B65B 43/42

(52) U.S. Cl. ..... 141/171; 141/9; 141/103; 141/104; 141/163; 53/474

(58) Field of Search ..... 141/171, 9, 100, 141/103, 104, 144, 163, 113, 319; 53/445, 471, 474, 239, 243; 215/11.4, DIG. 8

(56) References Cited

U.S. PATENT DOCUMENTS

| | | | | |
|---|---|---|---|---|
| 611,520 A | | 9/1898 | Smith | |
| 3,477,431 A | | 11/1969 | Walecka | 128/218 |
| 3,608,709 A | * | 9/1971 | Pike | 53/474 |
| 3,868,012 A | * | 2/1975 | Kinsley | 198/388 |
| 4,507,114 A | * | 3/1985 | Bohman et al. | 604/111 |
| 4,566,251 A | * | 1/1986 | Spisak et al. | 53/167 |
| 4,803,055 A | * | 2/1989 | Ueda | 422/297 |
| 5,025,612 A | * | 6/1991 | Monsees | 53/243 |
| 5,291,991 A | * | 3/1994 | Meyer | 215/DIG. 8 |
| 5,337,794 A | | 8/1994 | Nishiyama et al. | 141/144 |
| 5,687,779 A | | 11/1997 | Andersson et al. | 141/105 |
| 5,692,644 A | * | 12/1997 | Gueret | 215/DIG. 8 |
| 5,714,023 A | * | 2/1998 | Redfern | 156/69 |
| 5,806,282 A | * | 9/1998 | Hansen | 53/471 |
| 6,045,254 A | * | 4/2000 | Inbar et al. | 215/DIG. 8 |
| 6,113,257 A | | 9/2000 | Sharon et al. | 366/130 |
| 2002/0053190 A1 | * | 5/2002 | Haggman et al. | |

FOREIGN PATENT DOCUMENTS

| | | | |
|---|---|---|---|
| FR | 2 746 082 | 9/1997 | B65D/81/32 |
| WO | WO 97/34815 | 9/1997 | B65D/81/00 |

* cited by examiner

*Primary Examiner*—Timothy L. Maust
*Assistant Examiner*—Khoa Huynh
(74) *Attorney, Agent, or Firm*—Pennie & Edmonds LLP

(57) ABSTRACT

A process and apparatus for preparing a multi-compartment container having two open ends and a partition wall that forms a fluid-tight seal defining two compartments each holding a separate component to be mixed with one another by the end-user prior to use. The process and apparatus for filling the two-compartment container comprises filling one compartment with material through an opening at one end of the container; sealing the opening; rotating the container; filling the other compartment with material through an opening at the other end of the container; and sealing the other opening preferably with a removable seal.

29 Claims, 21 Drawing Sheets

METHOD AND APPARATUS FOR FILLING A MULTI-COMPARTMENT CONTAINER

CROSS-REFERENCE TO RELATED APPLICATIONS

This is a continuation-in-part of application Ser. No. 09/542,286, filed Apr. 4, 2000, entitled "Method Of Preparing A Container To Store and Mix Separate Components Into A Liquid Formulation," the disclosure of which is incorporated herein by reference.

FIELD OF THE INVENTION

The invention relates to a method and system for filling a multi-compartment container, each compartment holding a separate component, to be mixed with one another by the end-user prior to use.

BACKGROUND OF THE INVENTION

A variety of formulations for human use are stored in the form of a dry particulate matter (powder) and are mixed with a liquid shortly before use to form a true solution or a dispersion. This is the case, for example, with various nutritive formulas, including maternal milk substitute formulas (baby formula), adult feeding formulas such as dietetic powders and a variety of drugs, e.g., antibiotics. The shelf life of such mixed liquid formulations is limited, and this dictates the need to prepare them only shortly before use. The limited shelf life of the mixed formulation is the result of a loss of activity of an active ingredient in the formula, for example, loss of activity due to accelerated oxidation and/or hydrolysis once the ingredient is mixed with a liquid, etc. In addition, in many cases, the mixed formulation can be more susceptible to micro-organism contamination.

In some applications, for example, formula for newborn babies and various drugs including antibiotics, it is important that a correct amount (weight and/or volume) of the dry particulate material be admixed with a correct amount (weight and/or volume) of the liquid when preparing the resulting formula. Too much or too little of any one of the required components alters the ratio and changes the resulting formulation which may need to be within close tolerances to have the appropriate effect. For example, in the case of baby formula if there is not enough dry formula the mixed liquid formulation will be diluted in which case the baby or infant will be undernourished, or if there is too much dry formula the mixed liquid formulation will be too concentrated which may give rise to digestive problems and vomiting.

In addition, in some applications it may be necessary that the filling, storing and mixing of the two compartments be performed under hygienic and in some cases sterile conditions and that the two components be of appropriate sterility and quality.

The preparation of baby formula in the home and hospitals is typically accomplished by providing cleaned and sterilized bottles and nipples, measuring a quantity of the powdered (dry particulate) material from a canister and placing it in the previously cleaned and sterilized bottle to which an appropriate measured amount of water (generally tap water), saline solution or milk is added. The nipple is then attached and the two components or components are then agitated to form the mixed liquid formula. A variety of drugs, for example, antibiotics are prepared in a similar manner by the pharmacist or the end-user.

In applications where a formula prepared by mixing two components has a short shelf-life or where the quantities, quality or sterility of the components is an important consideration in the preparation of the formula, a single container which could separately store the two components until the mixed formula is to be dispensed, permit the two components to be mixed in the container and permit the mixed formula to be dispensed from the container would be useful. In some such applications it may further be desirable that the container be pre-packaged and yet further desirable that it be configured and adapted for a single use by the end-user and even more desirable that the container be unusable after the single use. Such storage and dispensing containers would offer convenience, safety and potential savings to the end-user.

First, a pre-packaged two-compartment storage and dispensing container offers the convenience of having both component parts of a mixed formulation supplied in the correct amounts in a single easy to use container that is always ready to be mixed. In this manner, a traveler may take along as many pre-packaged containers as desired and mix the formula for use at any time, without having to measure the two or more components, or worry about forgetting or obtaining one of the components of the formula while traveling. Such a pre-packaged container, filled and packaged under the appropriate conditions, separately storing the component elements of a formula in a ready to mix manner, and adaptable to mix and dispense the resulting formulation provides a complete system for the end-user.

Second, two-compartment storage and dispensing containers offer the safety of being packaged in a manufacturing plant where the sterility of the environment and the quality and sterility of each of the components and mixed formula can be controlled. In addition, the quantity of each of the two separate components can be controlled through precise measurement if prepackaged in a container in a manufacturing facility.

SUMMARY OF THE INVENTION

A multi-compartment container of the type that meets the need described above are described in U.S. Pat. No. 6,045,254 whose disclosure is incorporated by reference herein. A method and apparatus for filling multi-compartment containers, and more specifically to an automated method and apparatus for filling multi-compartment, and preferably two-compartment containers which separately store two or more components for later mixing and dispensing is described herein.

In one embodiment, the automated method and apparatus is adapted for filling a two-compartment container having two open ends, where two or more components intended to be mixed prior to use are stored separately in each compartment. The first of such components is typically a liquid and the other a particulate solid, e.g., powdered substance. Of course, two liquids or two particulate solids (e.g. powders) may be separately stored for later mixing.

The method and apparatus for preparing a multi-compartment container may further check for leaks, maintain a sterile environment and prevent contamination of the respective compartments, including contamination from the components of the other compartments.

An example of the two-compartment container or a precursor to the two-compartment container that may be filled by the process and method described herein includes a housing having openings at both ends, the housing having a partition wall between the two openings which defines a first cavity and a second cavity. The partition wall preferably forms a seal with the housing and more preferably is movable between a sealed position, whereby a seal is formed between the first and the second cavities ("inter-compartmental seal"), and an unsealed position, whereby the first and second cavities intercommunicate.

When the partition wall is in the sealing position the contents of the two cavities, whether liquid or solid, do not mix. The container may further be provided with a displaceable member to move the partition wall from its sealed position to its unsealed position. In addition, or alternatively, the displaceable member may move the partition wall to its sealed position.

The seal of the partition wall may include an O-ring seal. The container may further comprise sealing members, sealing membranes, or sealing assemblies for sealing the openings so that compartments may be formed. A secondary seal for sealing the openings may also be included. According to a further feature of this embodiment there may also be provided a feeding nipple attached to the displaceable member or the container and in communication with the opening. The secondary seal may be exterior to the feeding nipple.

Another example of a two-compartment container comprises side walls, an opening at a top end, an opening at the bottom end capable of being fitted with a bottom wall, and a partition wall dividing the container in a fluid-tight manner into two compartments, each for holding one of the two components. The container may include a displaceable vertical elongated member with a bottom end connected to the bottom wall and its top end connected to the partition wall such that vertical axial displacement of the bottom wall yields a vertical displacement of the displaceable elongated member causing movement of the partition wall.

The partition wall may also be integrally connected to an internal face of the side walls through a connecting zone which is breakable or tearable by vertical displacement thereof, and the elongated member extends downwardly from the partition wall to the bottom wall of the container. In accordance with this embodiment, displacement of the elongated member causes vertical displacement of the partition wall which yields a break or tear in the connecting zone. The tearing or breaking away of the partition wall results in flow communication between the two compartments and allows mixing of the contents of the two compartments. Mixing of the contents of the two compartments yields a formulation in a ready-to-use form which may then be dispensed.

In order to provide access to the lower compartment during the container filling process, the bottom wall may be provided as a separate piece from the container housing and fitted into the opening at the bottom of the container. After the lower compartment is filled with a component for a formulation, the bottom wall piece may be sealed to the container housing. The bottom wall may be flexible to allow vertical displacement at its center. Alternatively, rather than being entirely flexible, the bottom wall may also be rigid, having a flexible peripheral portion, allowing vertical displacement. In accordance with one embodiment, the bottom wall, when at rest, is downwardly arcuated and by applying upward pressure it assumes an alternate position where it is upwardly arcuate and pushes the elongated member and causing vertical displacement of the partition wall. In accordance with another embodiment, the bottom wall, when at rest, is upwardly arcuate and it is displaced by pulling it downward into the alternate position where it is downwardly arcuate. Such pulling may be by means of a handle or knob fixed at the bottom wall. As can readily be appreciated, a container as in these embodiments can be manipulated by one hand.

The displaceable member may be provided with a safety mechanism for avoiding unintentional axial displacement. By one example, the safety mechanism includes at least one radially projecting lug which is engaged in a partial circumferential groove in the container, and the displaceable member is rotated between the first angular position where the at least one lug is engaged in the groove and a second angular position wherein the lug is disengaged permitting axial displacement.

The container may comprise an integral closure member sealing the top opening, e.g., a breakable seal, which once broken allows one to dispense the mixed formulation from the container. The breakable seal may comprise a membrane where the membrane may be a foil or a non-metallic membrane, such as a plastic or a polymer membrane, and may have a single-layer structure or a multi-layered laminate structure. In this embodiment where the membrane seals the dispensing opening, the membrane seal is preferably of the type that may be peeled off to attach an appropriate dispensing system.

In another embodiment of the container, the partition wall may project from a manipulable portion of a displaceable member, which is fitted within an opening of the container and is user operable to allow displacement control of the partition wall. The manipulable portion may be exterior to the housing and preferably is easily accessible and operated by the end-user. In one example, the partition wall is connected at an end of one or more stems projecting from the manipulable portion.

In the case of a single stem, the stem will typically be centrally located, and in the case of a plurality of stems, they will typically be disposed in the periphery of the partition wall. In another example, the partition wall and the manipulable portion may be connected by a peripheral wall formed with openings. In a further example, the connection between the partition wall and the manipulable portion is by means of radial wall sections. The manipulable portion of the displaceable member may, in accordance with one embodiment of the invention, be adapted for screw engagement with the housing such that axial displacement is achieved as a result of helical displacement during rotation. In this case, the seal formed by the partition wall is controlled by rotation of a threaded displaceable member. In accordance with another embodiment of the invention, the displaceable member is engaged with the housing such that it is axially displaceable by means of pulling, or pushing, on the manipulable portion such that the partition wall engages or disengages with the neck portion.

The container may also be provided with a closure assembly fitted at an opening. A membrane as described above may comprise the closure assembly. The closure assembly may further be replaceable and may or may not cooperate with the displaceable member. The closure assembly may comprise a removable stopper.

The displaceable member may have a peripheral portion for displaceable engagement with a top end of the housing, and may have an outwardly extending aperture defining the dispensing opening. In another variation of a two-compartment container, the displaceable member may be engaged in a displaceable manner to the bottom end of the housing. Typically, in accordance with this embodiment, the displaceable member has a wall, defining the bottom wall of the container, which is provided with a sealable opening to allow filling of a component into a first compartment. Alternatively, the end of the displaceable member corresponding to the bottom end of the container may be completely open to allow filling of the first compartment. In other words, the bottom end of the displaceable member may not have a wall-like structure. This opening may be sealed with a stopper-like structure or sealed with a membrane structure using a heat seal process. This embodiment typically has a top opening opposite the bottom opening which is fitted with the displaceable member. The top opening may be a dispensing opening, but is not necessarily different than the sealable opening in the displaceable member.

The dispensing opening may be fitted with a simple membrane, such as, for example, a foil or laminate, or a closure assembly fashioned in a manner to allow a controlled release of the formulation from the container. The closure assembly fashioned in a manner depending on the intended use. For example, in the case of a container for medicinal formulation, the closure assembly may for example be a pierceable rubber stopper, adapted for inserting a syringe needle for withdrawal of the medicinal formulation; the closure assembly may also be fashioned in a manner allowing dispensing of a fixed amount of the formulation each time for a plurality of occurrences; the closure assembly may also be fashioned in the form of a spoon-shaped dispensing unit; in the case of a container intended for use as a baby's feeding bottle, the closure assembly may be a nipple sized and shaped according to its intended application. The closure assembly may also be fitted with an additional cover, e.g. foil covering a stopper or a cap covering the nipple, to secure the closure and/or maintain sterility. In the case of a cap covering a nipple, the cap may be fitted in a manner to seal the nipple's opening so as to avoid spillage of the liquid component during storage prior to mixing the liquid formulation.

Either both or one of the top opening and the bottom opening of the container may be sealed with a membrane. The membrane may be a foil or a non-metallic membrane, such as a plastic or a polymer membrane, and may have a single-layer structure or a multi-layered laminate structure. And as discussed before, where a membrane seals the dispensing opening, the membrane seal is of the type that may be peeled off to attach an appropriate dispensing system. For example, in a baby feeding bottle application, a baby feeding rubber nipple may be attached to the dispensing opening.

The multi-compartment container may be fashioned for a variety of uses. The container may serve as a baby's feeding bottle, in which case the first compartment may contain a liquid, typically sterilized water, and the second compartment may contain a powdered baby's formula. In another application, the container may be fashioned for storage of two components of a medicinal formulation, for example, the first compartment may contain a liquid, e.g., water or a sterilized saline solution, and the second compartment may contain a dry particulate drug formulation to be mixed with the liquid prior to use, e.g. an antibiotic drug formulation. Depending on the type of the formulation, the two components may be both liquids, one may be a liquid and the other may be a dry formulation or both may be dry formulations.

The relative size of the first compartment and the second compartment can be designed according to their intended use. The container may be made for a single use, the container generally being disposable after its single use. In addition, the container may be made to be recyclable, i.e. to be returned to the manufacturer after use for refilling. Furthermore, the container may also be made in a manner to allow refilling with the two components by the end-user. The container may further be constructed and made of materials to withstand heating the container in order to warm its contents.

It may be advantageous in some applications to provide a container which is only capable of a single use, in particular a pre-packaged container which is only capable of a single use, in order to prevent an end-user from reusing the container. Such a container may provide a manufacturer with control over the quality of the product delivered by preventing the end-user from refilling and reusing the container. A pre-packaged container offers the advantages of control over the proportion, quality and sterility of the components used and the delivered mixed formulation. It is envisioned that a single use container can be accomplished by controlling the strength of materials and construction of the container, preventing the ability to refill, destroying the operability of the container or a combination of these. For example, the container may be designed of a thin plastic material, or with a closure system which cannot be removed or re-closed after opening, or a seal that is not capable of being reformable (resealed) after it has been broken.

In accordance with one embodiment of the invention, a process and apparatus for filling a multi-compartment container for holding at least two separate components may comprise: providing a housing of a container having an internal space between a top opening and a bottom opening and a partition wall positioned between the top opening and the bottom opening defining an upper compartment and a lower compartment; conveying the container into a first component filling station; introducing a predetermined amount of the first component into the lower compartment through the bottom opening; sealing the lower compartment; conveying the container into a separating and rotating station; rotating the container so that the top opening is in an upward position; conveying the container into a second compartment filling station; filling the upper compartment with a predetermined amount of the second component of the formulation through the top opening; and sealing the upper compartment by sealing the top opening.

The process may further include one or more of the following steps; testing the integrity of the inter-compartmental seal, and filling one or more of the compartments under positive air pressure relative to the ambient environment to reduce contamination.

In another embodiment, the process comprises:

(a) providing a housing having a top and a bottom opening and a partition wall between the openings for forming a seal between a bottom and a top cavity;

(b) introducing a first component into the housing through one of the openings;

(c) introducing the second compartment into the housing through the other opening; and (d) sealing the openings.

By another embodiment, the process comprises: providing a housing for a container having an internal space extending between two open ends; positioning a displaceable member into the housing, the displaceable member having a partition wall for fluid-tight sealing engagement with the container housing between the two open ends, and being at least axially displaceable between a first position where the partition wall forms a fluid-tight seal with the container housing, and a second position where the partition wall disengages from the container housing to allow flow communication between the two compartments; positioning the displaceable member into the first position in the container; introducing a first component of the formulation into the first compartment through one of the two open ends and sealing that open end; and introducing the second component into the second compartment through the other open end; and sealing that other opening.

The process may further include one or more of the following steps; testing the integrity of the fluid-tight seal at the neck portion, rotating the container to change the direction of the open ends and filling one or more of the compartments under positive pressure to reduce contamination.

By another embodiment the process comprises:

(a) providing a body for use as a container having an internal space extending between two open ends, one of the two open ends being fitted with a displaceable member comprising, a wall portion sealably engaged with the body at that open end, a sealable filling aperture in the wall portion, a partition wall adapted to form a seal with the body and an extension member extending between the wall portion and the partition wall; the displaceable member fitted within the body such that the partition wall forms a seal creating a first compartment and a second compartment;

(b) introducing a first component through the filling aperture;

(c) sealing the filling aperture;

(d) introducing a second component into the opening opposite the displaceable member, and (e) sealing the open end opposite the displaceable member.

The process may further include one or more of the following steps; testing the seal at the partition wall, rotating the container to change direction of the open ends and filling one or more of the compartments under positive pressure to reduce contamination. The process further may be performed under aseptic or sterile conditions.

The invention will now be illustrated in some specific embodiments directed toward a baby's feeding bottle and a medicine container in accordance with the invention. It will be appreciated by the artisan that the same principle is also applicable in other applications and areas where it is desired to fill, preferably automatically, a multi-compartment container having two open ends for storing two or more components of a formulation which are to be mixed prior to use.

BRIEF DESCRIPTION OF THE DRAWINGS

FIG. 5B is in a state where the partition wall seals the two compartments and FIG. 5C is in a state where the partition wall is displaced to allow communication between the two compartments;

FIGS. 6A–6C is a longitudinal cross-section through a baby's feeding bottle in accordance with another embodiment, wherein FIG. 6A is in a state where the two compartments are sealed from one another; FIG. 6B is in a state where the partition wall is moved providing for communication between the two compartments; and FIG. 6C is an exploded view of the container of FIGS. 6A and B;

DETAILED DESCRIPTION OF A SPECIFIC EMBODIMENT

The process of the present invention is related to preparation of a variety of multi-compartment containers. Some examples of the multi-compartment containers are provided to illustrate various specific configurations and examples and the invention should not be regarded as being limited to these embodiments. The containers may also be used for different uses, e.g. two or more compartment containers for medicinal formulations, dietary powders to be reconstituted with a liquid, alcoholic beverages to form cocktails with other ingredients, wherein one compartment contains one component and the other compartment contains another different component to be mixed to form a formulation.

Figure 1C:
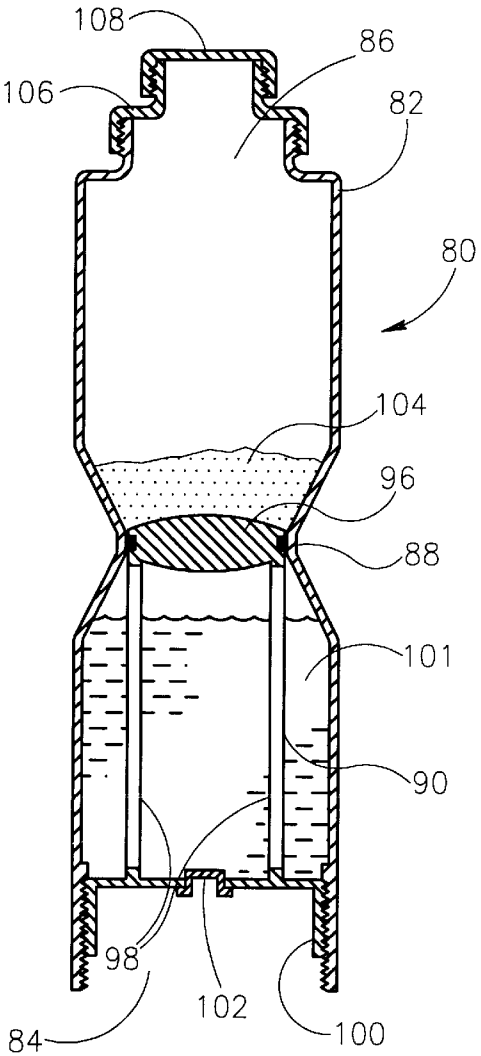
FIGS. 1A–1C show sequential steps in filling of a container in accordance with an embodiment of the invention.
Figure 1B:
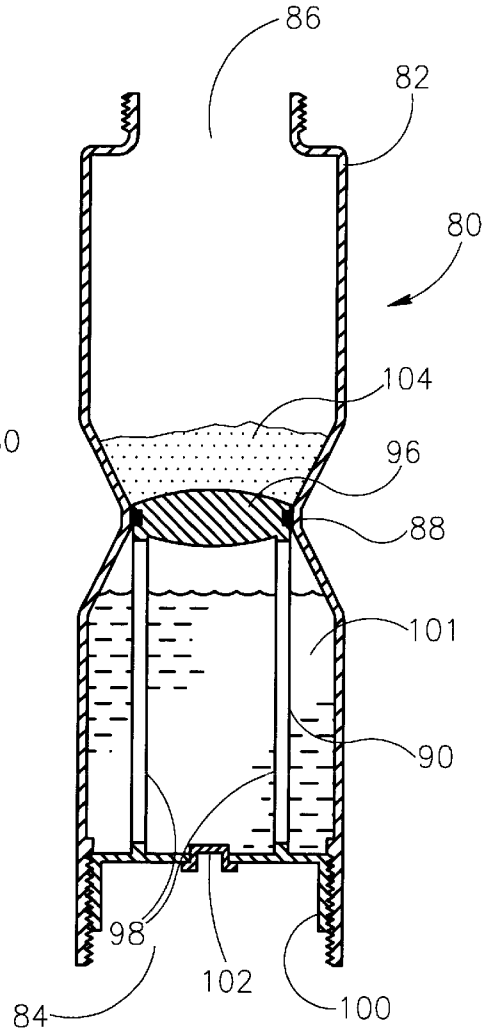
Figure 1A:
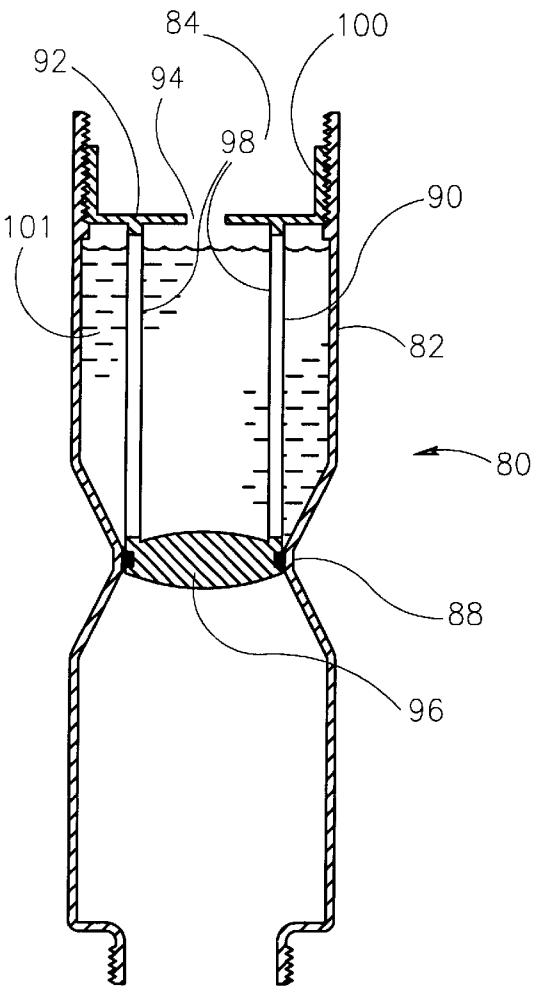

FIGS. 1A–1C show the construction and steps in filling a two-compartment container 80. Container 80 is formed from a generally tubular body 82 with an opening 84 at an end of the body constituting the bottom of the container and a second opening 86 at an opposed top end. Intermediate between the top and bottom ends is a constricted neck portion 88. While container 80 has been formed with a constricted neck portion, the neck portion may also be formed as described with reference to FIGS. 5A–5C.

Displaceable member 90, having an end wall 92 with a sealable filling aperture 94 and a partition wall 96 dependent from end wall 92 by stems 98, is fitted at end 84 by screw-threading at its peripheral portion 100. As a result of this screw-threading, the displaceable member 90 rotates causing axial displacement of partition wall 96 with respect to neck portion 88. After engagement of displaceable member 90 with body 82, and in particular partition wall 96 forming a fluid-tight seal with neck portion 88, a first component 101, e.g. water, is introduced through aperture 94, which is then sealed by stopper 102.

Typically, partition wall 96 is formed to complement neck portion 88 and may include a resilient O-ring seal, formed from silicone rubber or the like, held between opposing pieces of a molded plastic assembly. Alternatively, planar or otherwise shaped abutment surfaces may be provided for sealing neck portion 88. The fluid-tight seal formed by the partition wall with the neck portion may be reformable, i.e. the two compartments are resealable. Alternatively, the partition wall and neck portion may be configured so that the seal is not capable of being reformed.

The container is then rotated into the position seen in FIG. 1B, with opening 86 facing upward. Then a second component 104, e.g. a powdered formula, is introduced through opening 86 which is then sealed by closure assembly 106. Closure assembly 106 may be provided with resealable closure 108.

The seals formed by stopper 102 and closure assemblies 106 and 108 may be hermetically sealed so that the seals withstand the container being subject to pressures which are higher or lower than the internal container pressure such as may occur during air transport for example. By sealing both ends of the container in this manner, the seals will withstand conditions such as a vacuum condition that may occur during air transport, and neither compartment will undergo a change in pressure which may detrimentally affect the seal between the partition wall and abutment. Tightly sealing both ends of the housing helps to prevent the premature mixing of the components which may occur if the pressure in either one of the top or bottom compartments changes which may compromise the inter-compartmental seal formed by the partition wall.

Figure 2B:
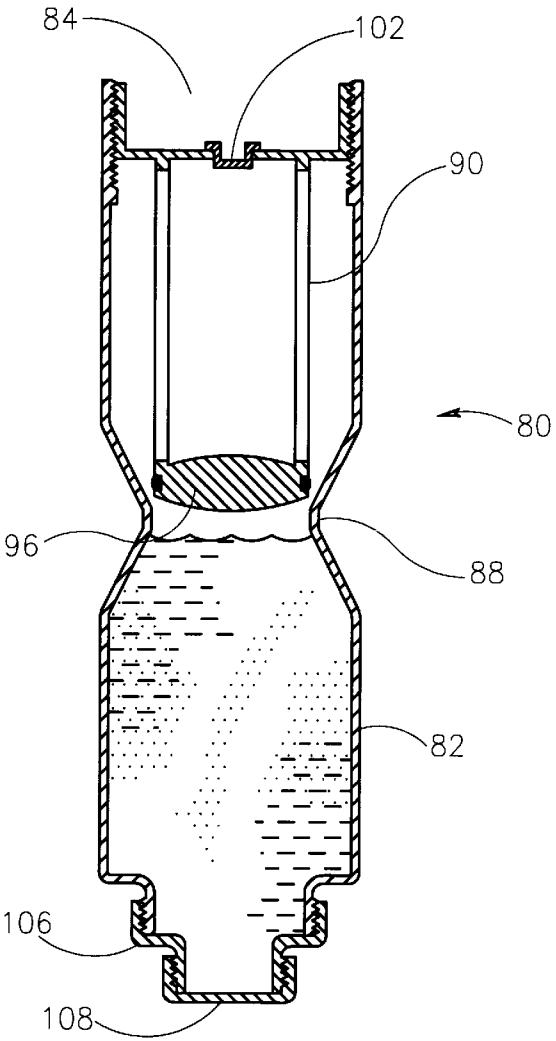
FIGS. 2A and 2B show steps in preparation of the formulation stored in the container of FIG. 1 for dispensing.
Figure 2A:
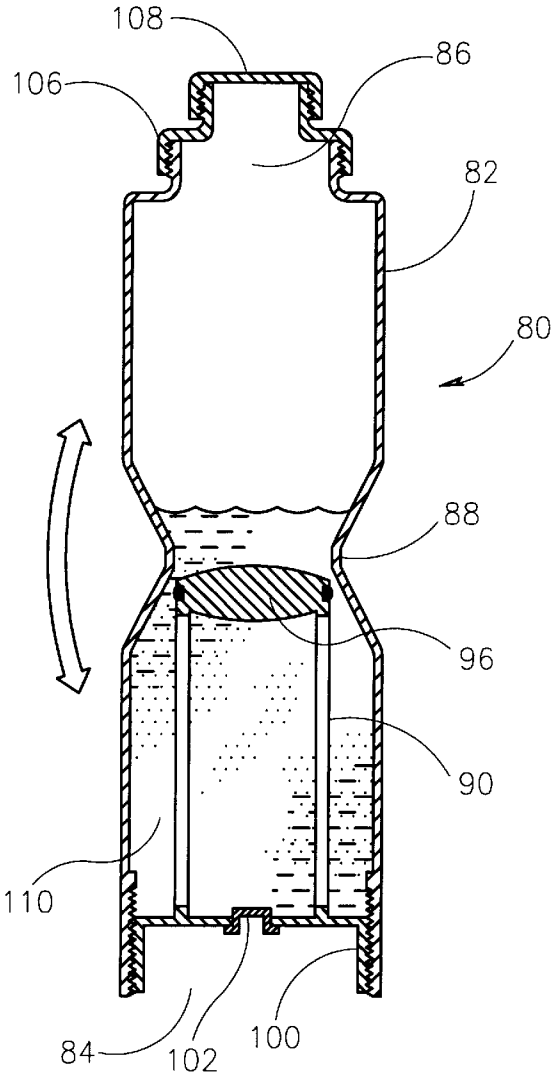

Preparing the container of FIGS. 1A–1C for use and dispensing of the formulation is shown in FIGS. 2A and 2B. In a first stage, shown in FIG. 2A, the displaceable member 90 is rotated such that partition wall disengages neck portion 88 to allow mixing of components 101 and 104 to yield liquid formulation 110. After mixing and homogenization, the container may be rotated for dispensing through closure 108 as shown in FIG. 2B.

Another embodiment of a two-compartment container 120 is shown in FIGS. 3A–3F. Container 120 is similar to container 80, shown in FIGS. 1 and 2, and so is its manner of filling, with a difference residing in assembly 122 which allows dosing of the liquid formulation 124.

Figure 3B:
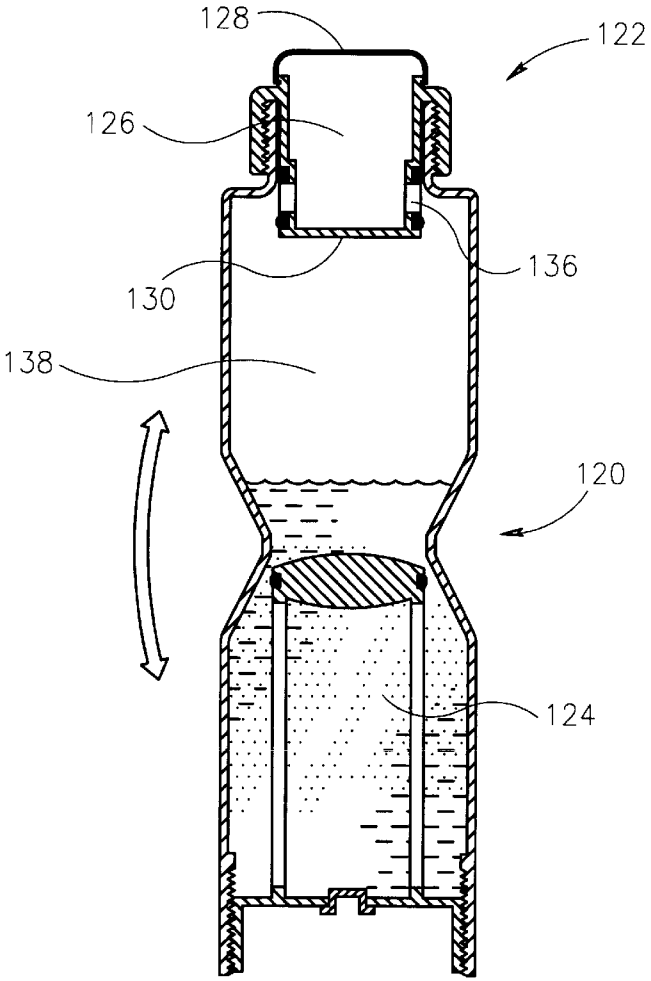
FIGS. 3A–3F show steps in preparation of a formulation for dispensing in a medicinal container that includes a formulation dosing arrangement.
Figure 3A:
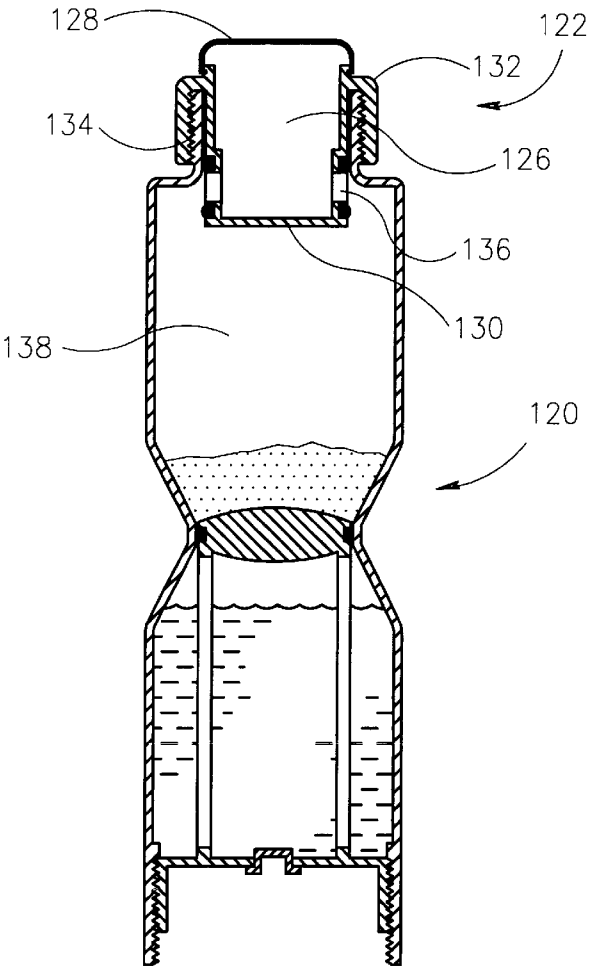
Figure 3D:
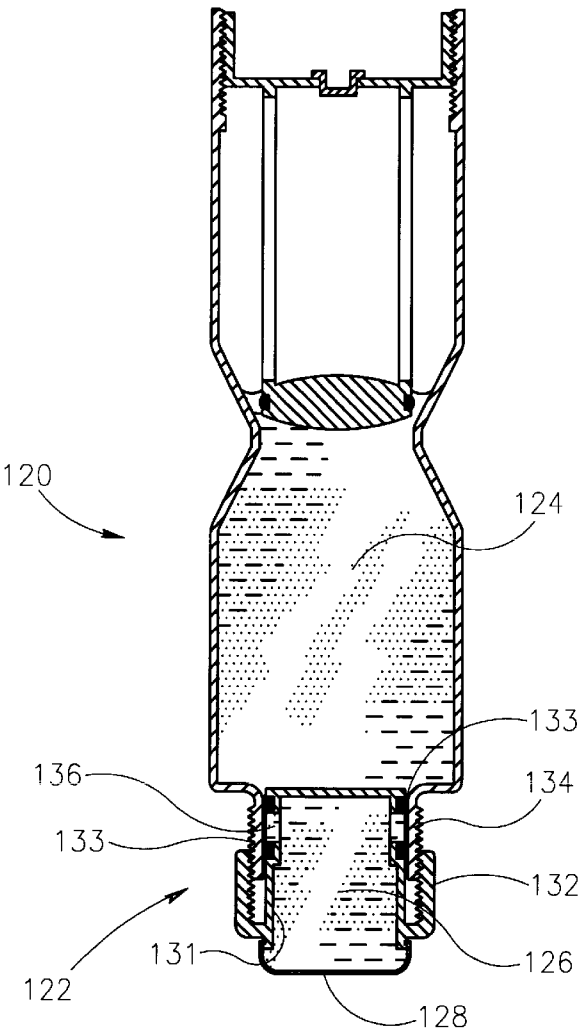
Figure 3C:
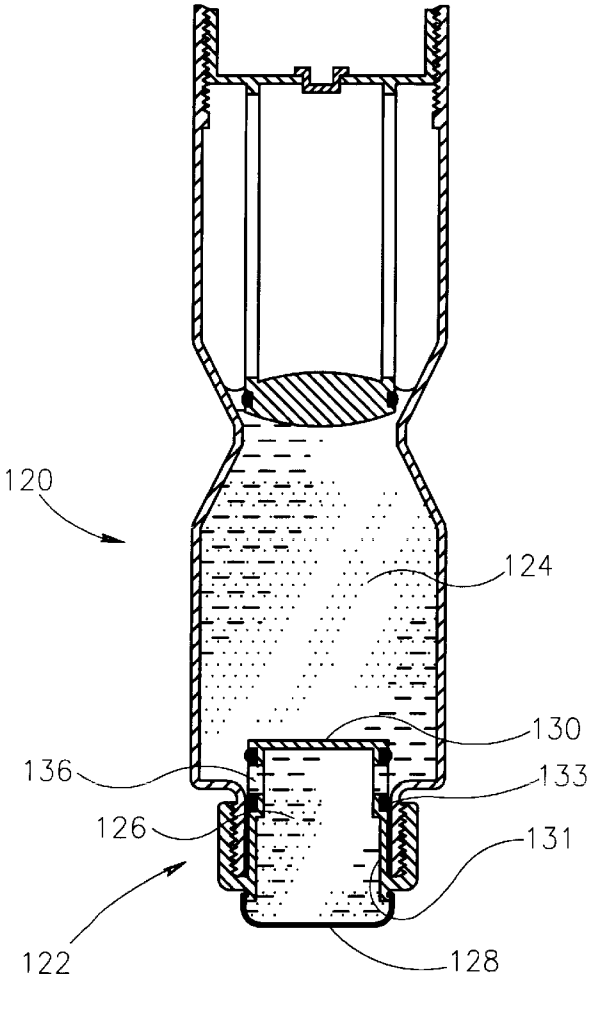

FIGS. 3A through 3F show different steps in the preparation and dispensing of the formulation. Assembly 122 defines a compartment 126 formed between a lid 128 and a bottom wall 130 of the assembly 122. Lid 128 forms a fluid-tight seal with the top end of the assembly. The assembly 122 has a skirt 132 which screw engages with screw thread 134 at the opening of container 120. The assembly further has openings 136 which in the position shown in FIGS. 3A–3C, provide for communication between compartment 126 and interior space 138 of container 120.

Figure 3F:
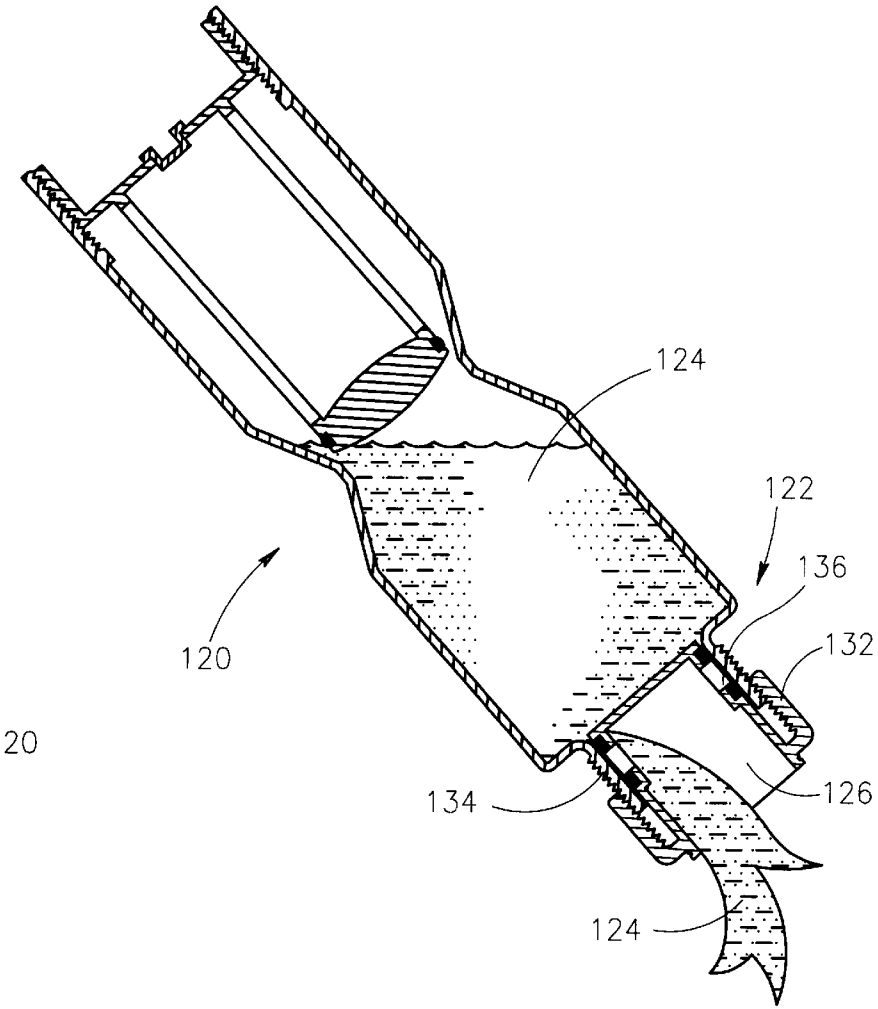
Figure 3E:
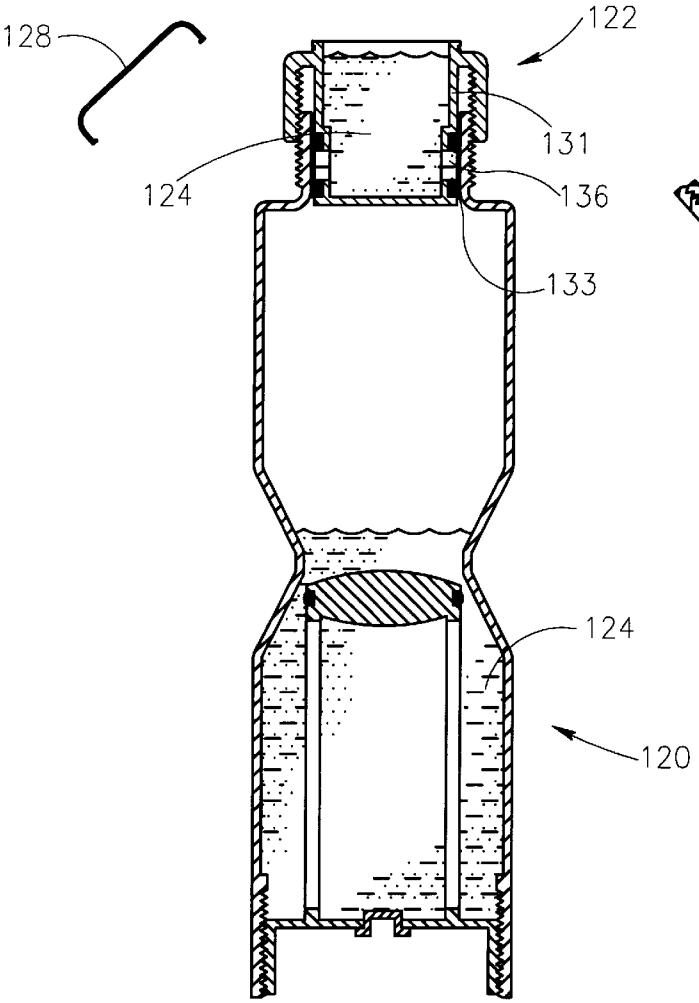

After mixing the two components, as shown in FIG. 3B, the container is rotated and consequently the liquid formulation fills compartment 126 through openings 136 (FIG. 3C). The assembly 122 is then rotated so that openings 136 are closed (FIG. 3D) and the container 120 can be turned upright (FIG. 3E). The side wall 131 of the closure assembly forms a reformable fluid-tight seal with the housing to prevent the liquid formulation or any of the separate components from leaking from the container. O-rings 133 may be provided to form or assist in forming the fluid-tight seal. Then the lid 128 can be removed and the contents of compartment 126 may be dispensed (FIG. 3F).

Another embodiment of a container 150 is shown in FIGS. 4A–4E. Here again, this container 150 differs from containers 80 and 120 in the nature of the closure and dosing assembly 152. The manner of dosing is shown in FIGS. 4A–4E.

The dosing assembly 152 has an end wall 155 with a depending skirt 153 along its peripheral edge which has screw threads 151 which engage cooperating screw threads 154 on the opening of container 150. End wall 155 has an aperture 156 which is fitted with a cylindrical central pipe 158. A fluid tight seal is provided between central pipe 158 and end wall 155 so that neither the components nor mixed liquid formulation leaks from the container. Central pipe 158 opens into and communicates with a dosing compartment 157. Compartment 157 is sized to hold an appropriate and predetermined amount of liquid formulation. The top side of compartment 157 is formed with a number of small holes 159 which are configured to allow the liquid formulation to enter and be trapped in the dosing compartment 157. Cap 149 is provided on central pipe 158 and provides a fluid tight seal.

Figure 4C:
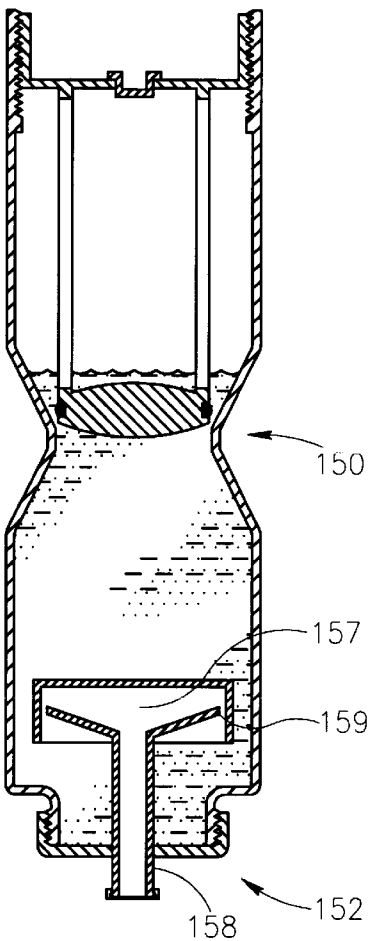
FIGS. 4A–4E show sequential steps in the preparation for dispensing of a medicinal formulation stored in a container with a different dosing arrangement.
Figure 4B:
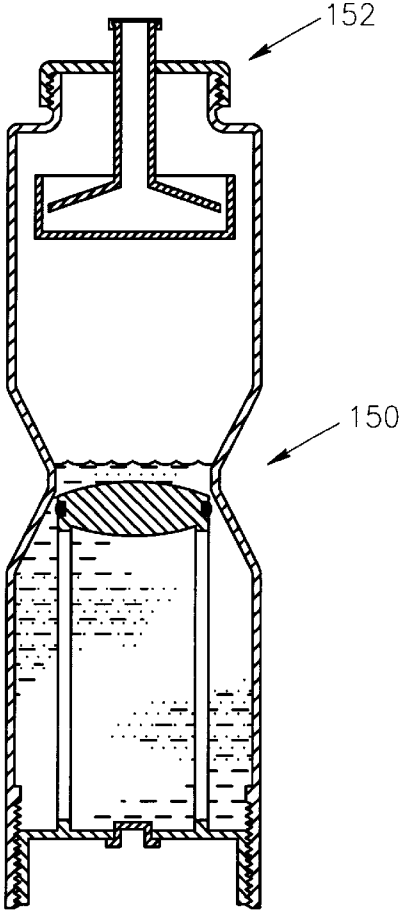
Figure 4A:
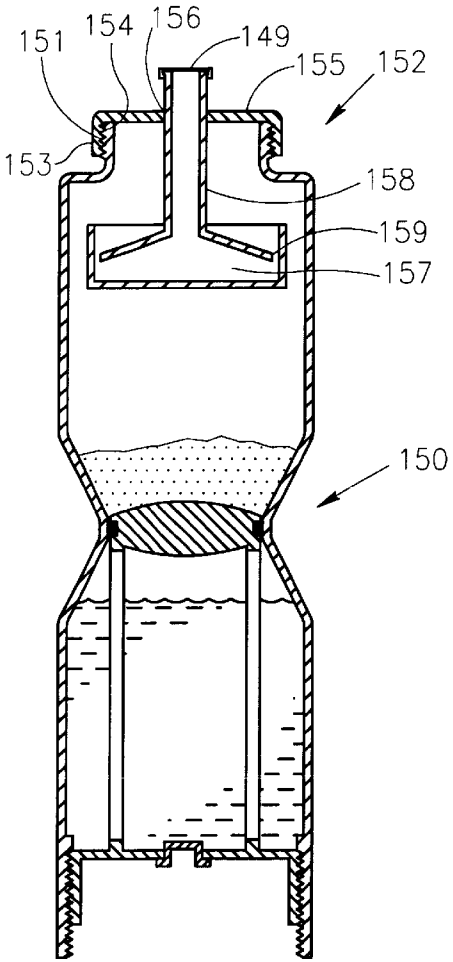
Figure 4E:
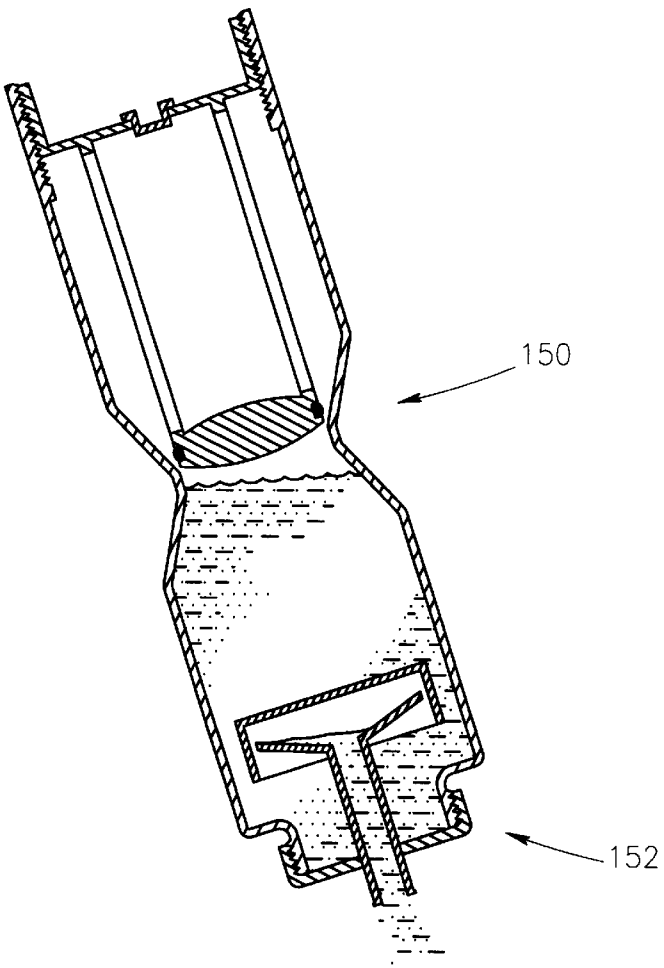
Figure 4D:
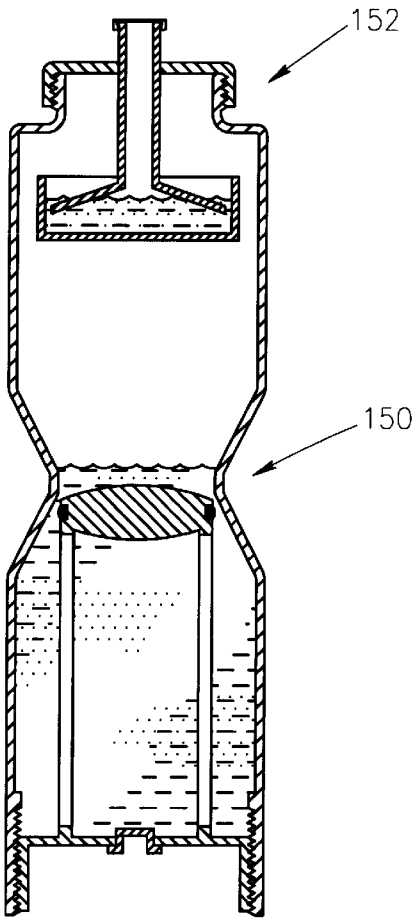

In FIG. 4A, the two-compartment container separately stores the two components, in this case a dry powder in the upper compartment and a liquid in the bottom compartment, until the liquid formulation is to be prepared. When the liquid formulation is to be prepared, the displaceable member is moved so that the upper and lower compartments intercommunicate as shown in FIG. 4B. The entire container may be moved, such as for example, by shaking or agitating, to facilitate the preparation of the liquid formulation. In FIG. 4C, the container is turned upside down and the liquid formulation flows through small holes 159 into the dosing compartment 157. When dosing compartment 157 is full, the container is then turned back into its upright position as shown in FIG. 4D. Cap 149 is thereafter removed and the liquid formulation is dispensed through central pipe 158 as shown in FIG. 4E. Since central pipe 158 has a much larger cross section and opening than do all of small holes 159, the dosage amount in dosing compartment 150 is dispensed in FIG. 4D before small holes 159 allow additional liquid formulation into dosing compartment 157.

Figure 5C:
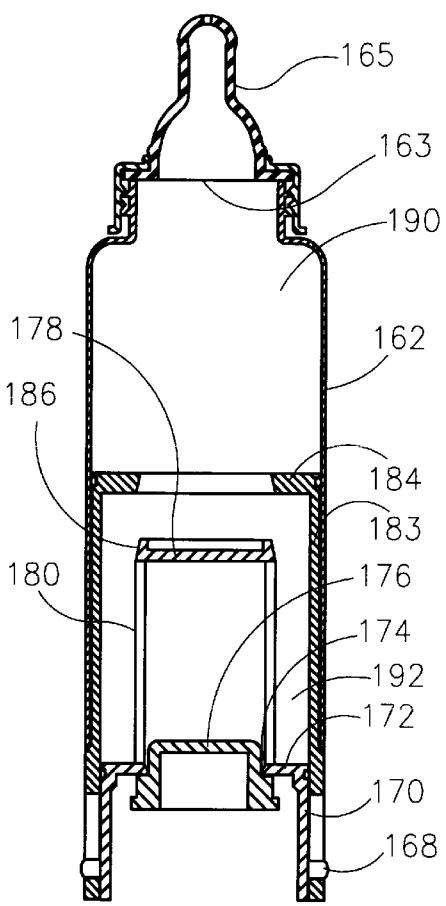
FIGS. 5B and 5C show a longitudinal cross-section through the bottle of FIG. 5A, where
Figure 5B:
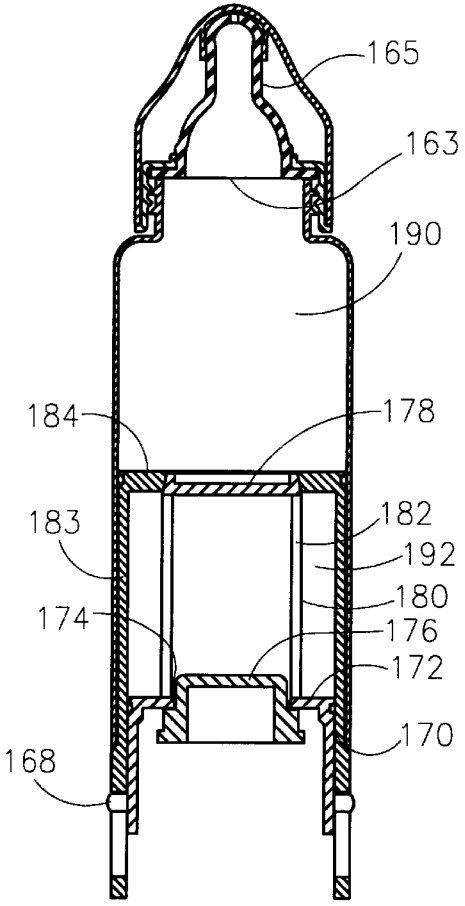
Figure 5A:
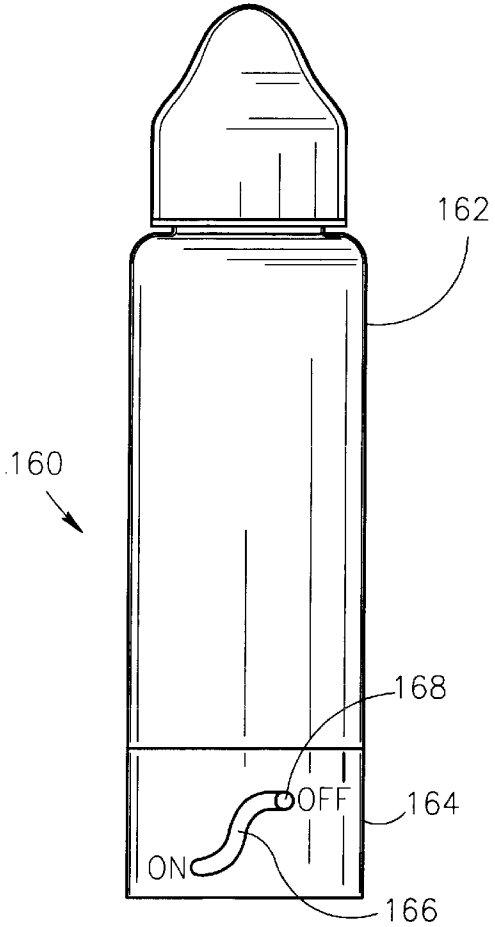
FIG. 5A shows a side view of an example of a baby's feeding bottle.

Another embodiment of a two-compartment container 160 is shown in FIGS. 5A–5C as a baby's feeding bottle 160 having a body 162 and a bottom end 164. A displaceable member 170 is formed with a bottom portion 172 having a central opening 174 sealed by a stopper 176 and having a partition wall 178 connected to the bottom portion 172 by means of a cylindrical wall 180 formed with openings 182. Instead of a constricted neck portion, housing 162 has an inwardly extending radial wall 184 defining a neck portion 185 which cooperates with partition wall 178 to provide a seal, as shown in FIG. 5B, between an upper compartment 190 and a bottom compartment 192 so that the contents of the two compartments do not mix prematurely. In FIGS. 5A–5C, housing 162 accommodates a sleeve 183 which at its top end has inwardly extending radial wall 184 which cooperates with a sealing annulus 186 on partition wall 178 to form the fluid-tight seal. The seal may be reformable (i.e., it is resealable) or be constructed to form a seal which cannot be reformed after the partition wall disengages from the neck. The displaceable member is axially displaced to the position seen in FIG. 5C so that compartments 190 and 192 come into fluid communication with one another. The liquid formulation may then be mixed and dispensed through the nipple closure arrangement which may be constructed as described above or according to manners known in the art.

Bottom end 164 in FIGS. 5A–5C is formed with a helical groove 166. Groove 166 slidingly accommodates a knob 168 which causes axial displacement of displaceable member 170 by rotation of the knob 168 between a first position, marked by the word "OFF", where the knob is positioned in FIGS. 5A and 5B, and a second position, marked by the word "ON", seen in FIG. 5A. Detents may be provided in groove 166 to retain knob 168 in either the "on" or "off" position. Alternatively, bottom end 164 may have helical threads which cooperate with helical threads on displaceable member 170.

Figure 6A:
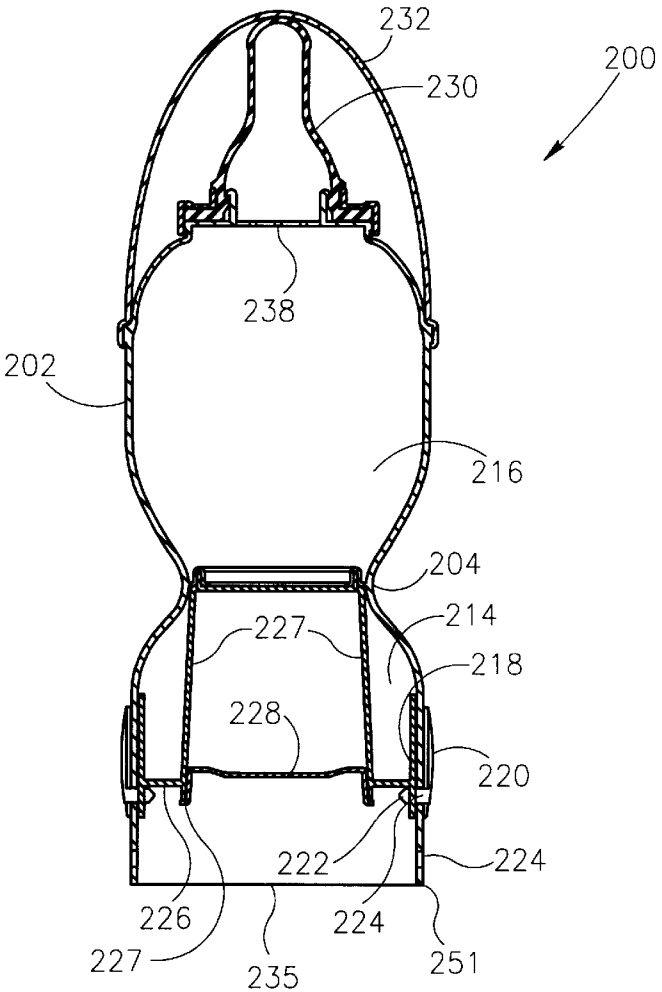
Figure 6B:
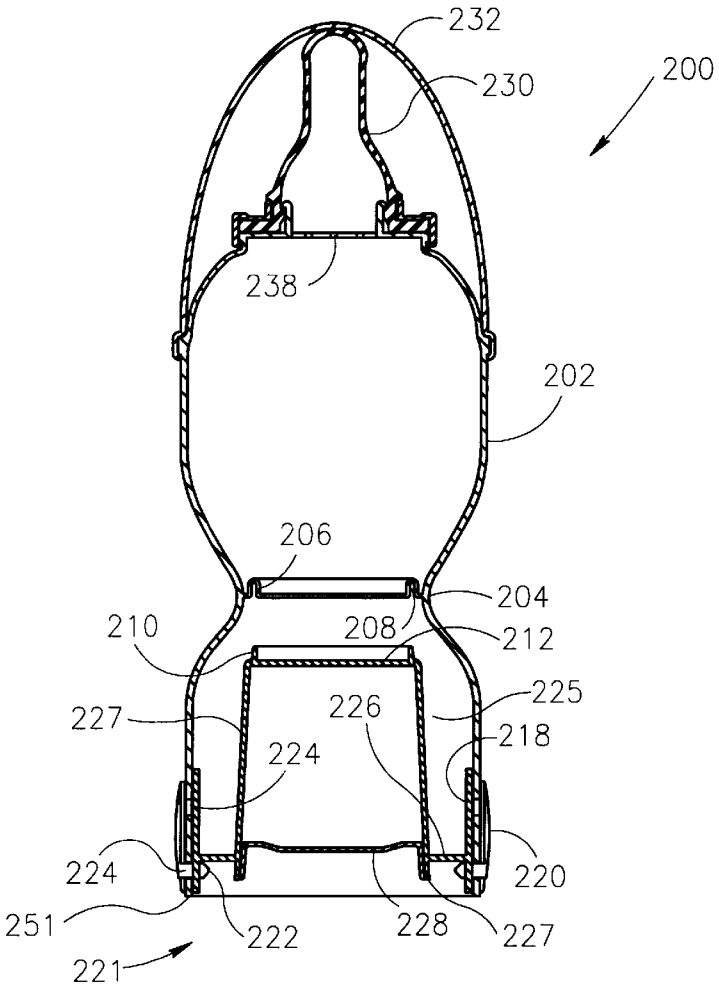

A different embodiment of a baby's feeding bottle 200 is shown in FIGS. 6A–6B having a housing 202 which is generally cylindrical and has a constricted neck portion 204. Alternatively, the diameter of housing 202 may remain constant or may change at or near the neck portion so that the diameter of the housing is larger on one side of neck portion 204. For example, in another embodiment illustrated in FIG. 6D, the diameter of housing 202 is larger on the bottom side of neck portion 204. Inwardly projecting from neck portion 204 is an annular engagement member 206 formed with a downwardly-facing groove 208 which cooperates with an annular projection 210 projecting from a partition wall 212 to provide a fluid-tight seal between a bottom compartment 214 of the container and a upper compartment 216 as shown in FIG. 6A. The partition wall 212 forms part of a displaceable member 218 which has a user manipulable portion 220 for axially displacing the displaceable member between a sealing position and an open position.

The displaceable member further has a bottom portion 226 having a sealable opening 229 sealed with a stopper 228. The partition wall 212 is connected to the bottom portion 226 by a cylindrical wall 225 having openings 227. The stopper 228 allows a component, e.g. powdered baby formula, to be introduced into a bottom compartment 214.

The baby's feeding bottle 200 has an opening 238 fitted with a nipple 230 with the nipple being protected by a cover 232 which may be attached to the housing by a snap fit or cooperating threaded portions. The upper compartment 216 in the embodiment of FIGS. 6A and 6B is specifically sized to store the liquid and/or fluid substance while the bottom compartment 214 is sized to store the dry substance. It is envisioned that certain advantages and better mixing may result from the liquid and/or fluid being added to the dry substance in the lower compartment. For example, storing the powder in compartment 216 can lead to blockage of the nipple by undissolved powder.

Figure 6C:
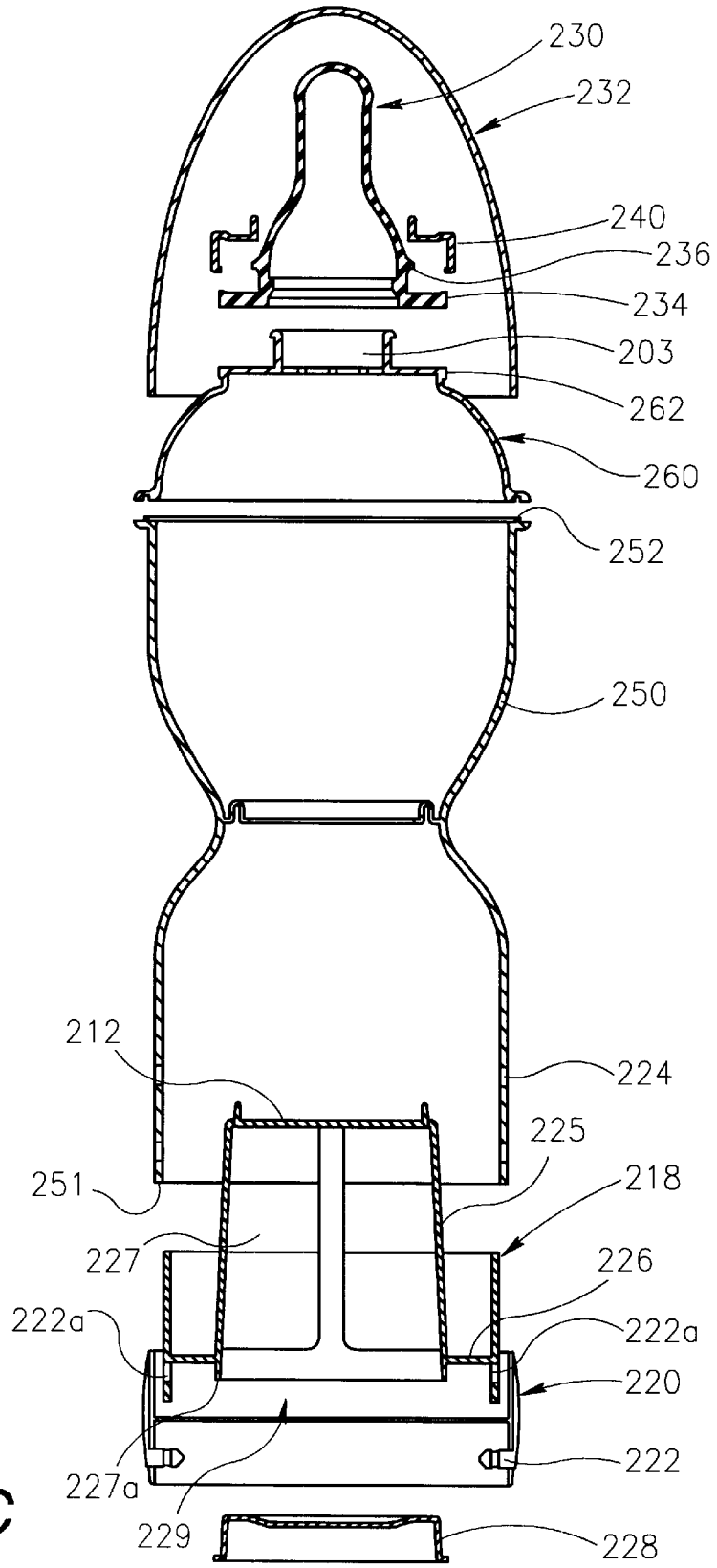

In FIG. 6C an exploded version of FIGS. 6A–B is shown. Housing 202 is constructed by assembling main tank 250, having neck portion 204 and inwardly projecting annular engagement member 206, with nipple seat 260 by ultrasonic welding so that main tank 250 and nipple seat 260 form fluid tight compartment 216. Alternatively, main tank 250 and nipple seat 260 may be formed as a one-piece unit. The opening 238 in the top end of the housing 202 may be fitted with nipple 230 which is held in place by a nipple clamping ring 240. The nipple clamping ring 240 mates with a shoulder 234 formed on the nipple 230 and is held in place by protuberances 236 formed on the nipple 230 and by lip 262 formed on nipple seat 260. The nipple clamping ring 240 couples the nipple 230 to the container by being snap fitted over lip 262.

The assembly of nipple 230 on housing 202 with nipple clamping ring 240 is designed so that the container is for a single use. For example, nipple clamping ring 240 can be designed to snap onto lip 262 in a manner so that if the ring is removed, it cannot be refastened to the container. Alternatively, or in addition to, nipple clamping ring 240 can be designed so that it cannot be removed after it has been snap fit into place on the nipple seat 260. Other attributes of the container which may make it particularly adaptable for a single use are its materials and ease of construction, and the thickness of materials used.

Alternatively, the top opening of main tank 250 may be sealed with a membrane that preferably may be peeled off before use. The membrane (not shown) may be a polymer or non-metallic material, a metallic foil, or a polymer-coated metallic foil membrane as may be appropriate. For example, where a microwave compatible pre-filled bottle is desired, a non-metallic membrane, such as a plastic or a polymer membrane, would be preferable. The top opening of main tank 250 may be configured so that a nipple 230 may fit directly onto the rim of the main tank 250 without the need for a separate nipple seat 260. The nipple may be placed over the membrane or alternatively placed over the opening after the membrane has been removed.

The sealable opening on the bottom portion 226 of the displaceable member 218 may also be sealed with a membrane either in addition to or instead of a stopper 228. In a single-use application the membrane on the bottom opening may preferably be sealed in a permanent manner so that it may not be easily peeled off to prevent accidental opening.

In either case, it is preferable that a second sealing is provided along the bottom side rim 251 of container housing 202. The second seal may also be accomplished with a form of a stopper similar to 228 or a membrane seal 235 as shown in FIG. 6A. The second seal helps protect the inter-compartmental seal formed by displaceable member 218 and container housing 202 from being compromised. This is especially a concern where the containers may be transported via air transportation. During an air cargo transportation, the container may be exposed to low air pressure conditions of high altitude. Without the second seal, the ambient low pressure condition will operate like a vacuum and exert a pulling force on the displaceable member. Because this pulling force is in the same direction as the displaceable member's activation direction, i.e., away from the inter-compartmental seal, the low pressure transport condition presents some concern for the integrity of the inter-compartmental seal. The second membrane seal along the bottom side rim 251 of the container housing isolates the displaceable member 218 from the ambient condition, thus, decreasing the risk that the inter-compartmental seal will be compromised. Such second seal may also provide additional protection for the first seal sealing the bottom opening of the displaceable member.

FIG. 6C also shows displaceable member 218 with manipulable ring portion 220. Displaceable member 218 is inserted within the bottom end of housing 202 and manipulable portion 220 is fitted over the bottom end of the housing 202 and positioned so that pins 222 can be inserted within helical groove 224 and are snap fit through apertures **222*a* in displaceable member 218 to attach the manipulable portion 220 to the displaceable member. The pins and helical groove configuration allows the end-user to open the fluid-tight seal between the two compartments by rotating the user manipulable portion 220, thereby axially displacing the displaceable member downwardly to the position shown in FIG. 6B**.

Figure 6D:
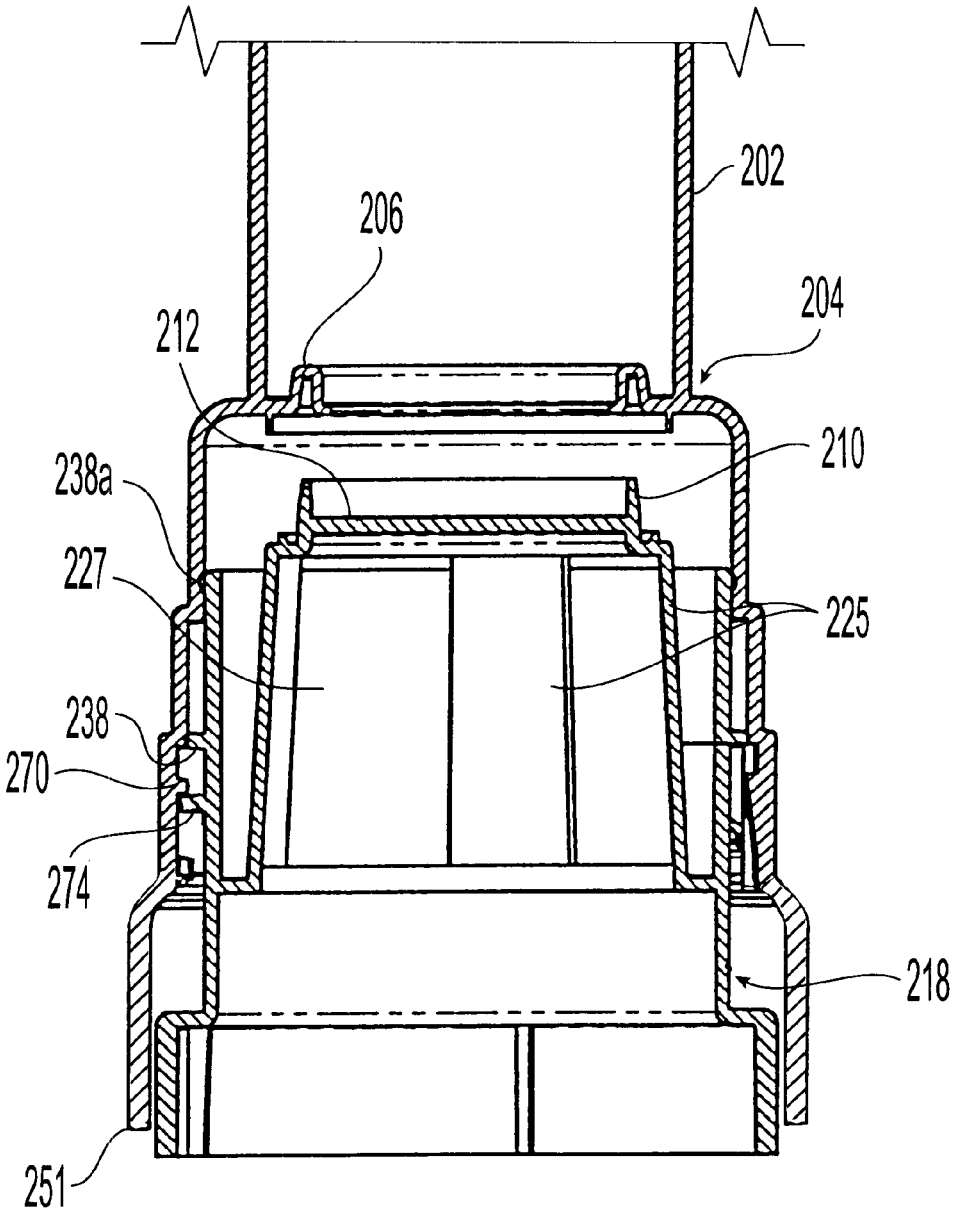
FIG. 6D is a longitudinal cross-section of the bottom portion of another variation of a bottle.

FIG. 6D illustrates an alternative structure for engaging displaceable member 218 and housing 202 that is another variation of the screw-thread structure illustrated in the container 80 of FIGS. 1A–1C. In this variation, thread structure 270 is provided on the inside surface of the housing 202 and the displaceable member's thread structure 274 is provided on the outside surface of the displaceable member 218. To open the seal between the two compartments, displaceable member 218 is rotated (typically in a counter-clockwise direction) so that the two thread structures 270 and 274 unscrew. This motion displaces the displaceable member 218 downward along the longitudinal axis of the container so that the annular projection 210 disengages from annular engagement member 206 and establishes a flow communication between the two compartments.

It should be noted that in the exemplary containers illustrated in FIGS. 6A and 6D, the cylindrical wall 225 with multiple openings 227 therein facilitates the thorough mixing of the two components, when the user agitates the container by shaking. This is especially effective when liquid/powder or liquid/liquid combinations are mixed. The structures 225 and 227 function to create a whisk or a mixer-like turbulence within the liquid being mixed.

As illustrated in FIG. 6D, displaceable member 218 may preferably be provided with additional sealing ridges 238 and 238*a* that sealably contact the inside surface of container housing 202. These sealing ridges preferably form liquid-tight seal so that the mixed liquid formulation does not leak when displaceable member 218 is in the unsealed position as illustrated in FIG. 6D. These seals, however, are preferably air permeable so that as the displaceable member is being unsealed the temporary vacuum condition created at the compartment-separating seal between annular engagement member 206 and annular projection 210 can draw air from outside the container. The temporary vacuum condition may make it difficult for the end-user to activate the displaceable member (in extreme cases this may prevent the displaceable member from being lowered altogether) or can distort and warp the container housing. But, the air permeable seal provided by ridges 238 and 238*a* allow air to be introduced into the container during the activation process equalizing the air pressure between the inside and outside of the container. This allows displaceable member 218 to be activated without encountering opposing suction force created by the temporary vacuum condition described above and alleviates distortion of the container. The sealing ridges 238 and 238*a* also stabilize the movement of displaceable member 218 during the activation step preventing the displaceable member from wobbling with respect to the longitudinal axis of the container.

Depending upon whether the container is for a single use or multiple uses the seal formed by the annular projection 210 (on partition wall 212) and groove 208 (on annular engagement member) can be designed to form a one use seal or a reformable seal (i.e., resealable). In some applications it may be desirable to have the container specifically constructed for a single use so the sterility of the container (and nipple arrangement) and the correction proportions, sterility and quality of the components are ensured. In the embodiment of FIGS. 6A–6C the annular projection 210 and groove may be configured and adapted for a single use such as by, for example, ultrasonically welding the two together wherein the welded joint pulls apart upon movement of the displaceable member 218. The annular projection and groove may also be configured and adapted to be resealable, that is, the seal can be broken and reformed by movement of the displaceable member.

It will be appreciated that filling of the container of FIGS. 5 and 6, their preparation for use and dispensing may be similar to the embodiment described in FIGS. 1A–C and 2A and B.

Figure 7:
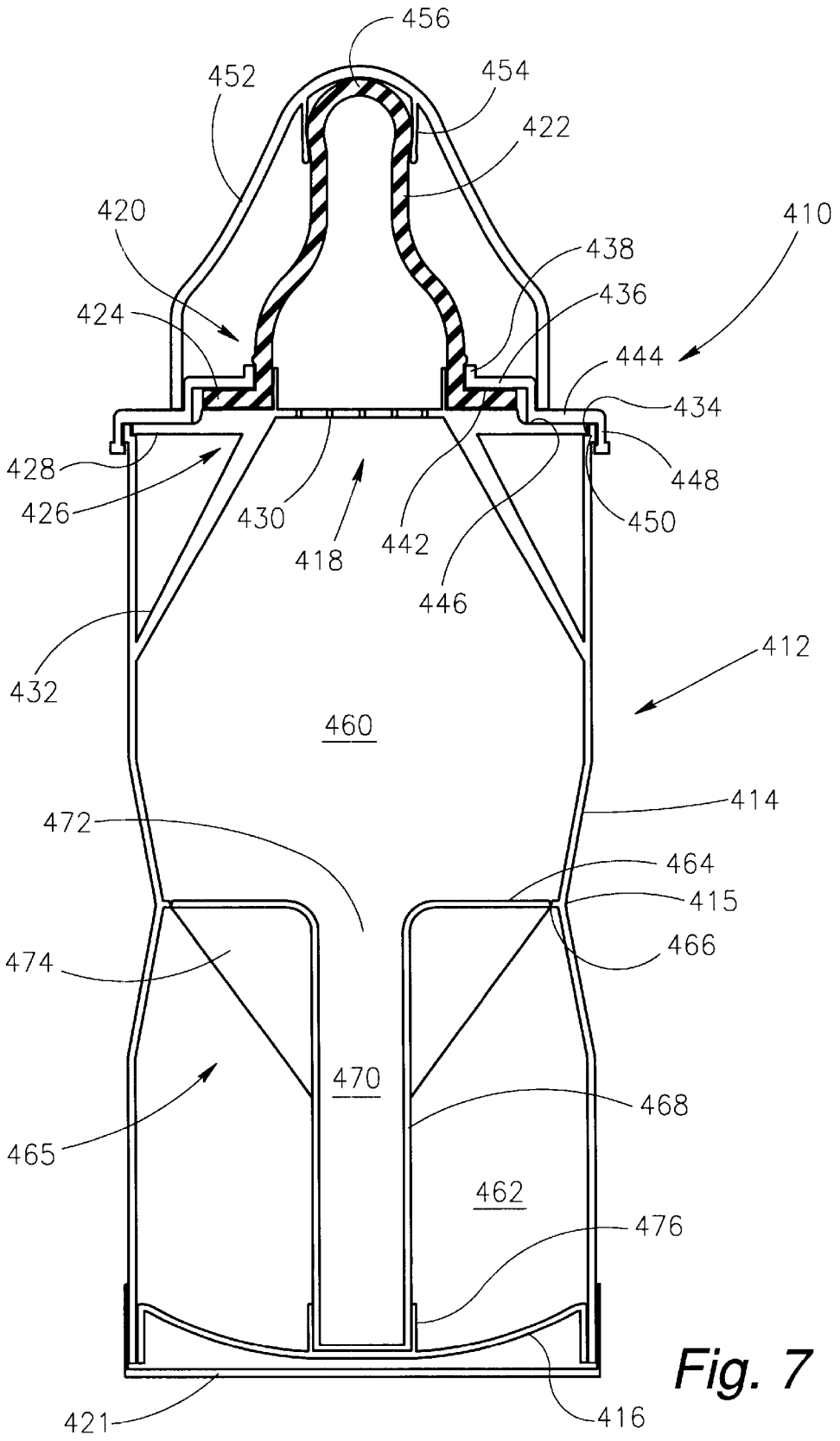
FIG. 7 shows a longitudinal cross-section through another two-compartment baby's feeding bottle.

Another variation of a baby's feeding bottle 410 is shown in FIG. 7. The container comprises a housing 412 of a general cylindrical shape with side walls 414, a bottom wall 416 and an opening 418 at its top fitted with a closure assembly 420. Fixed at the bottom end of the container is a tamper-resistant cover 421, the function of which will be explained further below.

Closure assembly 420 comprises a nipple 422, typically made of silicone rubber, latex rubber or any other FDA approved material adaptable for such purposes, having an annular skirt 424, mounted on a sealing member 426 having an annular portion 428 defining a central aperture 429 fitted with a sieve element 430 for filtering out undissolved food particles from the liquid formula, and having an upwardly extending cylindrical annulus 431 supporting the bottom inner face of nipple 422 and slanted support structure or legs 432. The edges of annular portion 428 are received in peripheral circumferential shoulder 434 at the top end of side walls 414 and the end of support structure 432 rests on the inner face of side walls 414. The nipple is held by an engagement member 436 having generally a stepped cross-sectional shape. The engagement member 436 has a first horizontal portion 442 pressing on skirt 424, a second annular horizontal portion 444 resting in peripheral recess 446 of seat member 426, and a peripheral downward extending portion 448 snappingly engaging shoulder 434 by means of annular bulge 450. This manner of engagement by means of engagement member 436 ensures a fluid tight attachment of the closure assembly 420 to opening 418. The fluid tightness of the engagement may at times be improved by the use of a rubber annulus placed below horizontal portion 444, etc.

As described with reference to FIGS. 6A–C, the nipple assembly can be configured and adapted so that the container is particularly suited for a single use, such as by for example, designing the engagement member to be unremovable or not capable of being refastened.

As can further be seen in FIG. 7, closure assembly 420 is fitted with cover 452 having a downward projecting cup member 454 receiving the top end of nipple 422 thus sealing its opening 456.

The container has two compartments, an upper compartment 460 and a bottom compartment 462 separated by a partition wall 464 integrally connected to side walls 414 through annular connecting zone 466. Extending downward from partition wall 464 is an elongated connecting member 468 having a hollow cavity 470 with an opening 472 at its top end and having reinforcing ribs 474. The bottom end of elongated member 468 is received by and connected to a cup member 476 projecting upwards from bottom wall 416.

Partition wall 464 provides a fluid tight separation between compartment 460 and 462. Upon vertical displacement as a result of upward pushing of bottom wall 416, the connecting zone 466 breaks thereby unifying the two compartments and allowing mixing of their contents. The seal formed in this embodiment by partition wall 464 is not reformable and the container is particularly adapted for a single use. In order to avoid accidental displacement of bottom wall 416, it is covered by tamper-resistant cover 421 which has to be removed to allow pushing of bottom wall 416. The tamper-resistant cover 421 may be removably attached by use of snap-fit arrangement, by screw coupling, by a tearable attachment zone, etc. Alternatively, the tamper-resistant cover may also be a foil or a film removable prior to use.

Figure 8C:
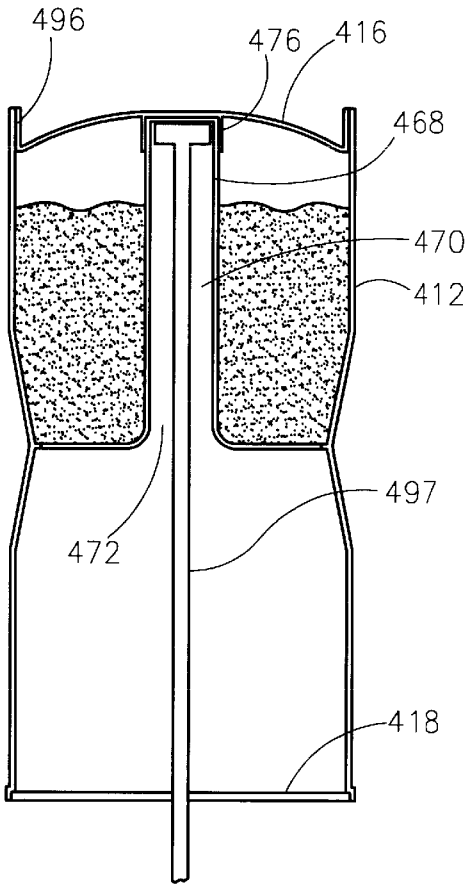
FIGS. 8A–8F illustrate the manner of filling of the baby's feeding bottle of FIG. 7 to store different components of a baby's formulation one in each compartment, and then breaking the partition wall between the compartments and mixing the two components to form the formulation prior to use.
Figure 8B:
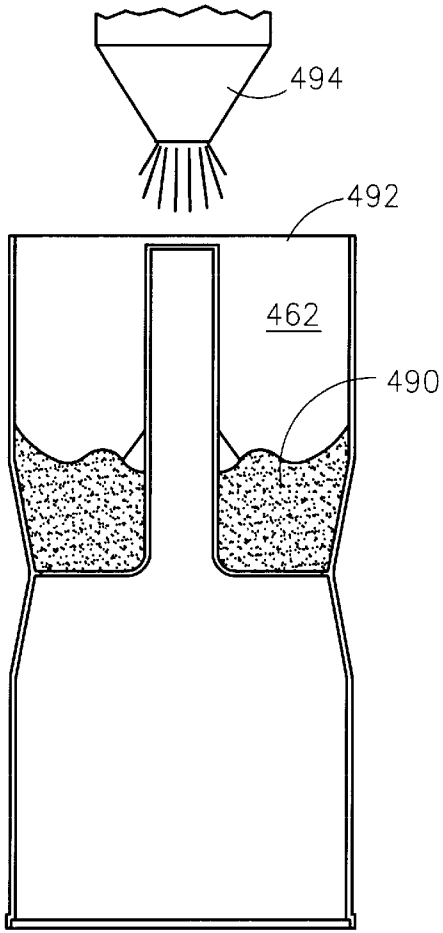
Figure 8A:
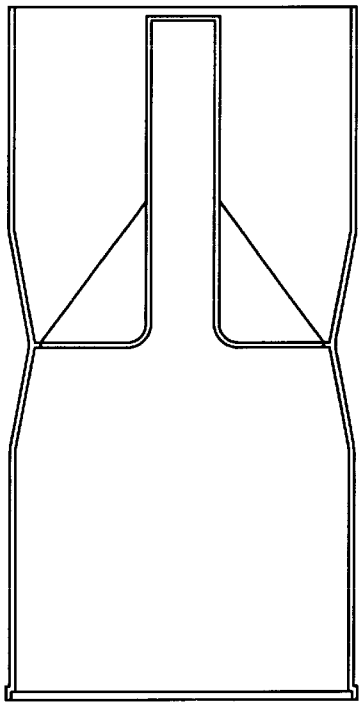

FIGS. 8A–8E illustrate the manner of preparation of the container, so that each compartment contains one component of a baby's feeding formula, e.g. powdered formula in the bottom compartment 462 and water in the upper compartment 460. However, this may obviously be reversed, i.e. the powdered formula at the top and water at the bottom. The container may be provided initially in the manner shown in FIG. 8A with a body or a housing 413 having an internal space between two openings, without bottom wall 416 and closure assembly 420, and placed in an inverted position. At a first step, shown in FIG. 8B, compartment 462 is filled with a dry powdered formula 490 introduced through the open end 492 via a dosing dispenser 494. At a next step, shown in FIG. 8C, the bottom wall 416, having a concave shape within annular skirt portion 496, is mounted over the open end 492 of the container and attached thereto. Preferably, the annular skirt portion 496 is attached to the internal face of wall 412 by sonic welding, although other forms of adherence are also possible such as gluing, or heat welding, etc. Cup member 476 is then fixed to a bottom end of elongated member 468 by sonic welding typically performed by inserting a probe 497 through opening 418 of the container and opening 472 of cavity 470.

Figure 8F:
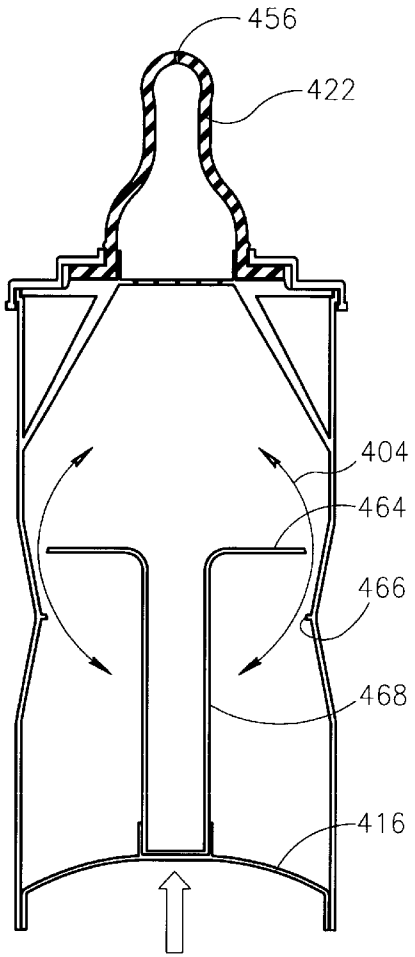
Figure 8E:
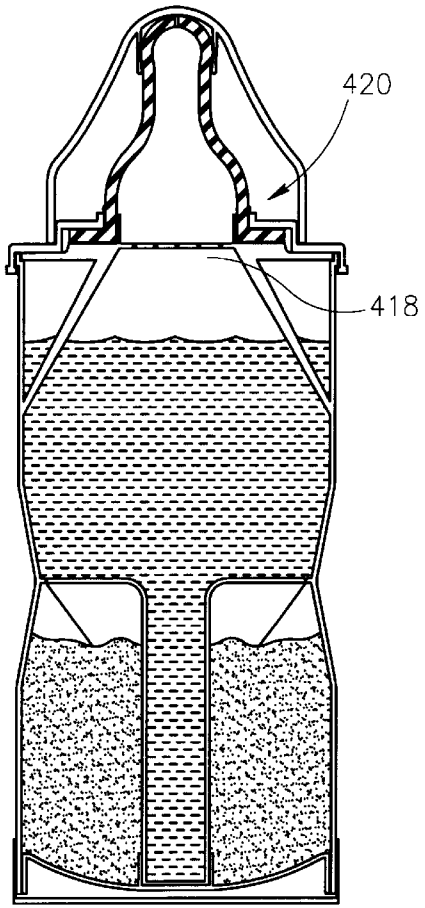
Figure 8D:
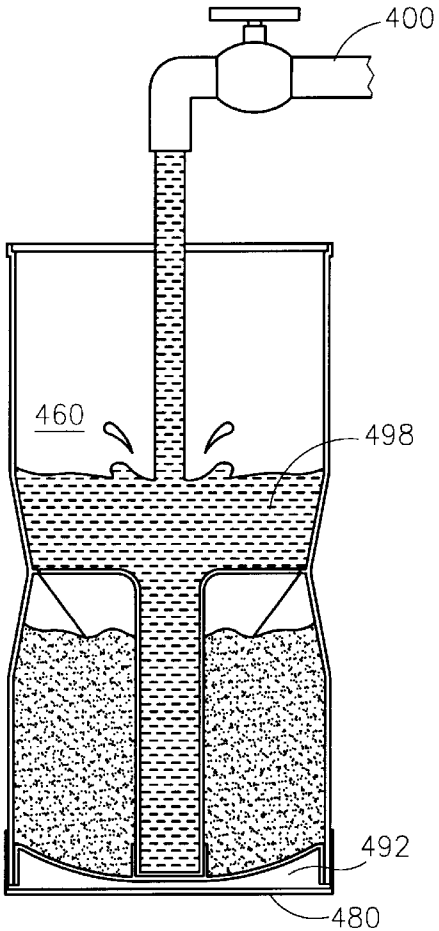

In the next step of preparation, shown in FIG. 8D, a tamper-resistant cover 480 is mounted over end 492 and the container is turned into its upright position and liquid (typically water) 498 is introduced into compartment 460 through a dispensing tap 400. Then, in a next step, shown in FIG. 8E, the closure assembly 420 is fitted over opening 418.

Preparing the container for use is shown in FIG. 8F. Prior to use, the tamper-resistant cover 480 is removed from the bottom end of the container and force is applied in a vertical direction on bottom wall 416, as represented by arrow 404, causing the wall 416 to assume the position seen in FIG. 8F, yielding a vertical axial displacement of elongated member 468 and partition wall 464. This tears or breaks the partition wall 464 at the connecting zone 466 whereby the contents of the two compartments can be mixed (represented by arrows 404). After mixing, the formulation is ready for use and dispensing through opening 456 of nipple 422 after removal of cap 452.

Figure 9:
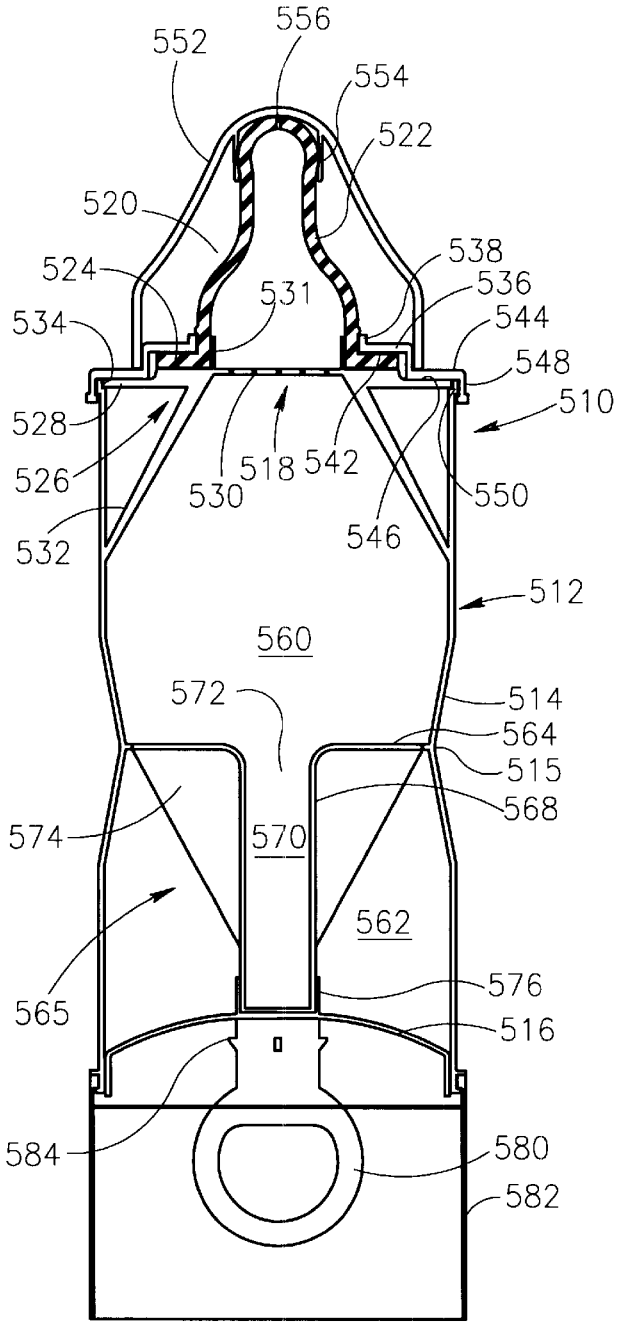
FIG. 9 is a longitudinal cross-section through another baby's feeding bottle.

Another baby's feeding bottle 510 shown in FIG. 9 is similar to the embodiment shown in FIG. 7 with all like elements given a reference numeral with the two last digits being the same as the corresponding element in FIG. 7. In distinction from the bottle of FIG. 7, the bottom wall 516 in FIG. 9 is upwardly arcuate having integral handle 580 confined within a space defined by the bottle's base member 582.

Figure 10:
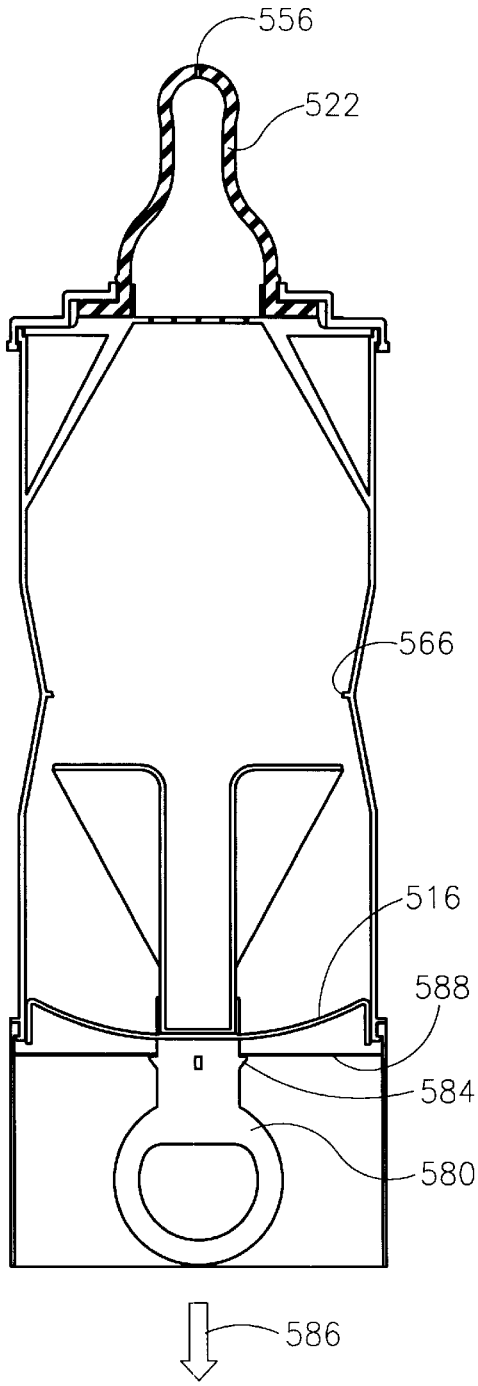
FIG. 10 shows a baby's feeding bottle of FIG. 9 in use when mixing the two components into final formulation and preparation for use.

As shown in FIG. 10, when the handle 580 is pulled downward in the direction of arrow 586, wall 516 becomes downwardly arcuate with the displacement causing breaking or tearing of connecting zone 566 allowing mixing of the contents of the two compartments, similarly as in the embodiment of FIGS. 7 and 8. Handle 580 has several engagement teeth 584 which serve, as can be seen in FIG. 9, for engagement with accessory wall 588, to hold a bottom wall 516 in the downwardly arcuate position. Once the contents of the two compartments have been mixed, and a ready-to-use formation is formed, it can be dispensed through opening 556 of nipple 522 after removal of cap 552.

It should be appreciated that the containers of the type discussed herein may be used to advantage for a wide range of implementations of two-compartment containers. Possible implementations include, but are not limited to, food, beverage and pharmaceutical applications, and may employ two liquid components, two particulate solids, or one liquid and one solid component. It further should be appreciated that in some embodiments the container may also be particularly directed toward single use, pre-packaged two or more compartment containers which are easily and inexpensively constructed and filled so as to be disposable.

The container may also feature accessories specific to a given application for dispensing of the final mixture. Possibilities include, but are not limited to, feeding devices designed for infants or geriatrics and measuring cups or other devices for dispensing measured units for medicines and the like. By way of example only, the container has in some examples been illustrated herein with respect to an infant formula feeding bottle structure and in other examples to a dairy assembly.

It is significant to note that the containers described herein may be filled under a wide range of controlled conditions suited to a wide range of applications. The entire assembly process may be performed under sterile conditions and may use sterilized components and ingredients. In addition, one or both of the compartments, and particularly the compartment containing a powdered ingredient, may be partially evacuated. Alternatively, or additionally, an inert gas such as Nitrogen may be introduced, either above or below atmospheric pressure, to minimize oxidation of the contents during storage. Other special environmental conditions such as controlled humidity may also be employed as required.

An example of a process and apparatus for filling and preparing a two-compartment container with separate ingredients in the two compartments will be described. FIGS. 11–16 illustrate schematic renderings of an embodiment of a container-filling process station for filling a two-compartment container with a dry component, such as powder, in one compartment and liquid in the other compartment. In such application, the container filling process station preferably prevents cross-contamination of the two components, before and during the filling process. The station is preferably a single integrated machine and may contain multiple sections or substations as necessary. In a preferred embodiment for filling a two-compartment container the applicants have configured a filling process station with three substations: a dry content (powder) filling station 600; a separating and rotating station 650; and a liquid content (water) filling station 700.

Figure 16:
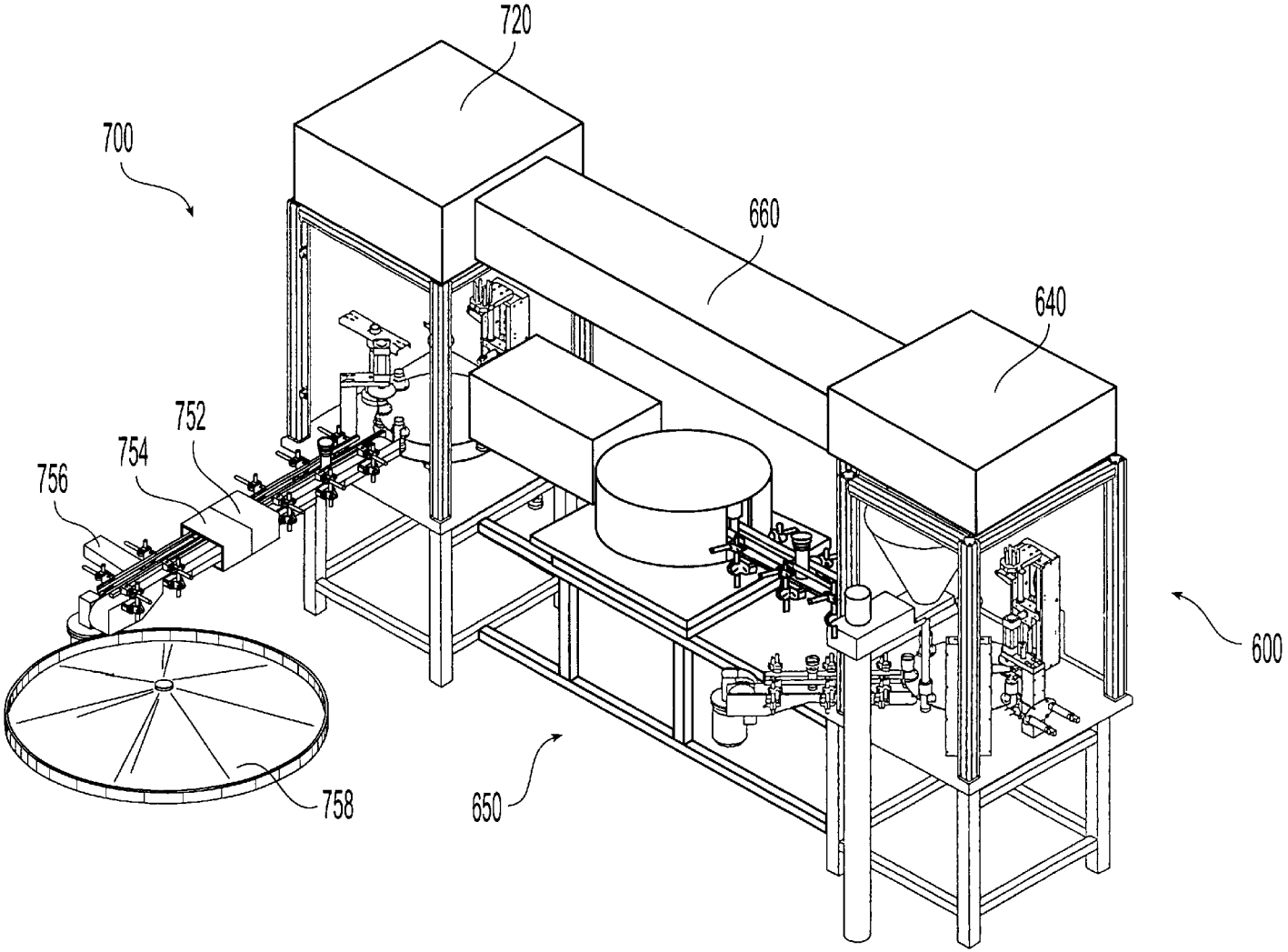
FIG. 16 is a perspective view of the full layout of the container filling station.

As shown in FIG. 16, each of the substations may be an enclosed unit provided with a dedicated air purification system, such as a filtered laminar air flow unit 640, 660, 720 that provides a supply of laminar air flow with a desired level of cleanliness for each substation and also keeps the environment for each substation separate from one another to prevent any cross-contamination. The laminar air flow units may maintain a positive air pressure within each enclosed substation relative to the ambient environment to keep contaminants from entering the substations.

Figure 11:
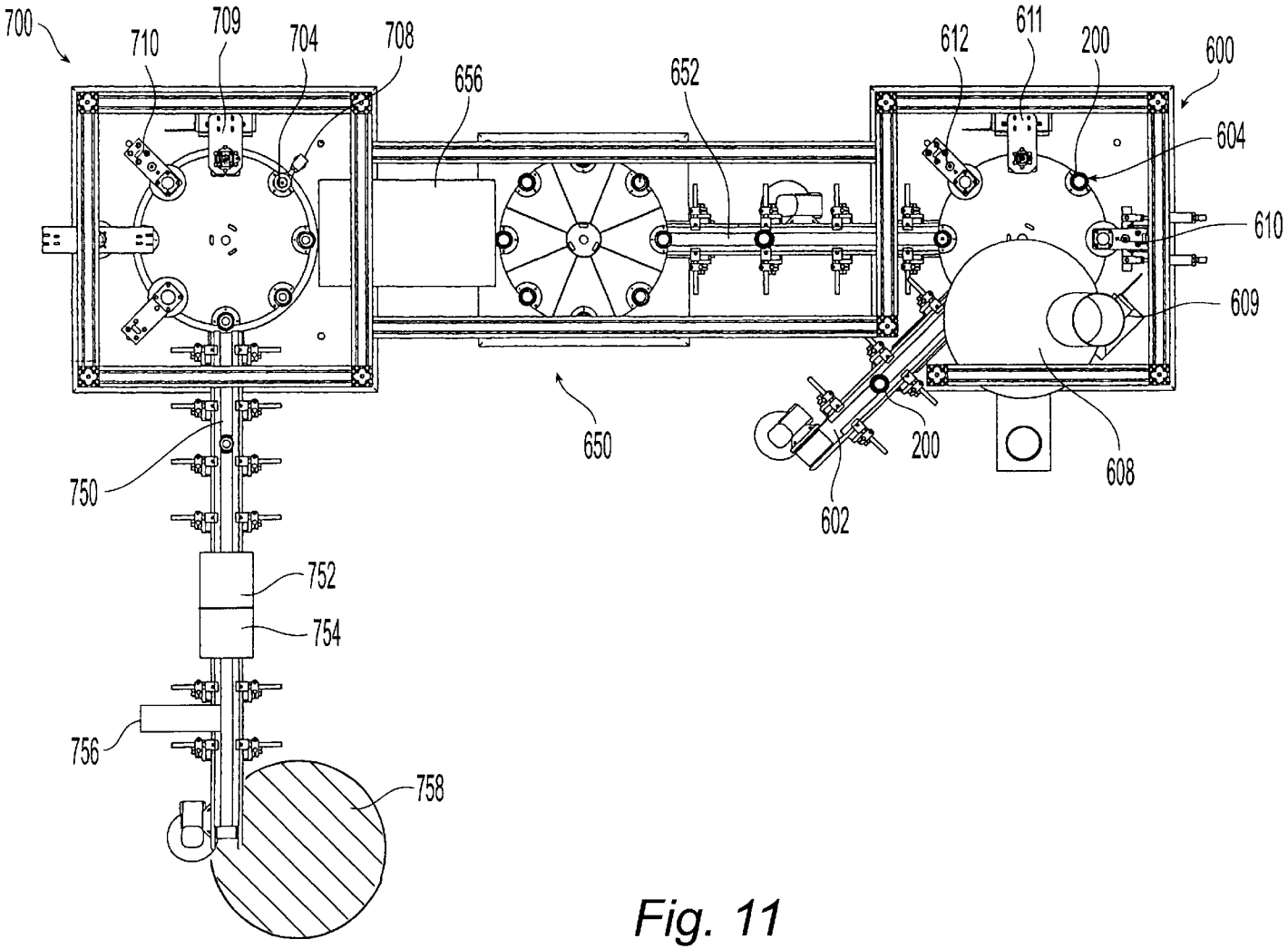
FIG. 11 is a schematic illustration of the layout of a container filling station where a multi-compartment container may be filled.

The exemplary container filling process station of FIG. 11 may be configured for filling any of the two-compartment containers described in FIGS. 1–10, as well as others, and will be described for ease of reference as filling the two-compartment baby's feeding bottle 200 illustrated in FIGS. 6A–6C whose top and bottom openings are sequentially sealed with membranes upon filling of the two compartments.

Figure 12:
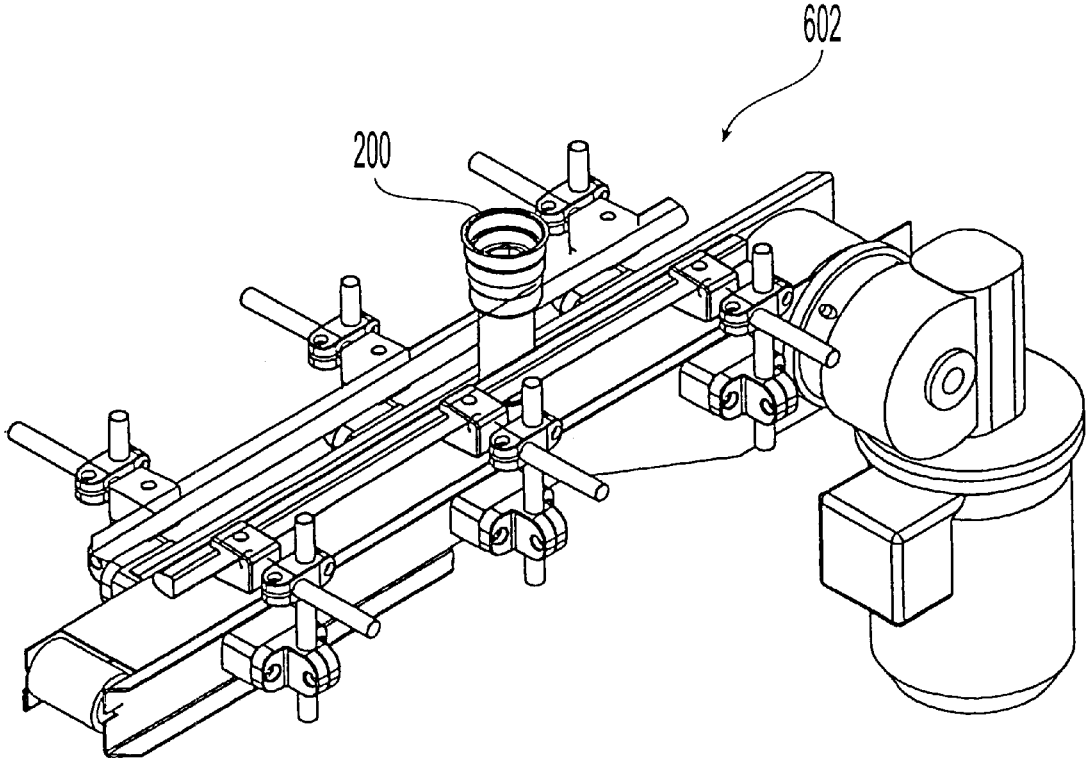
FIG. 12 is a perspective view of a conveyor unit used in the container filling station of FIG. 11.
Figure 13:
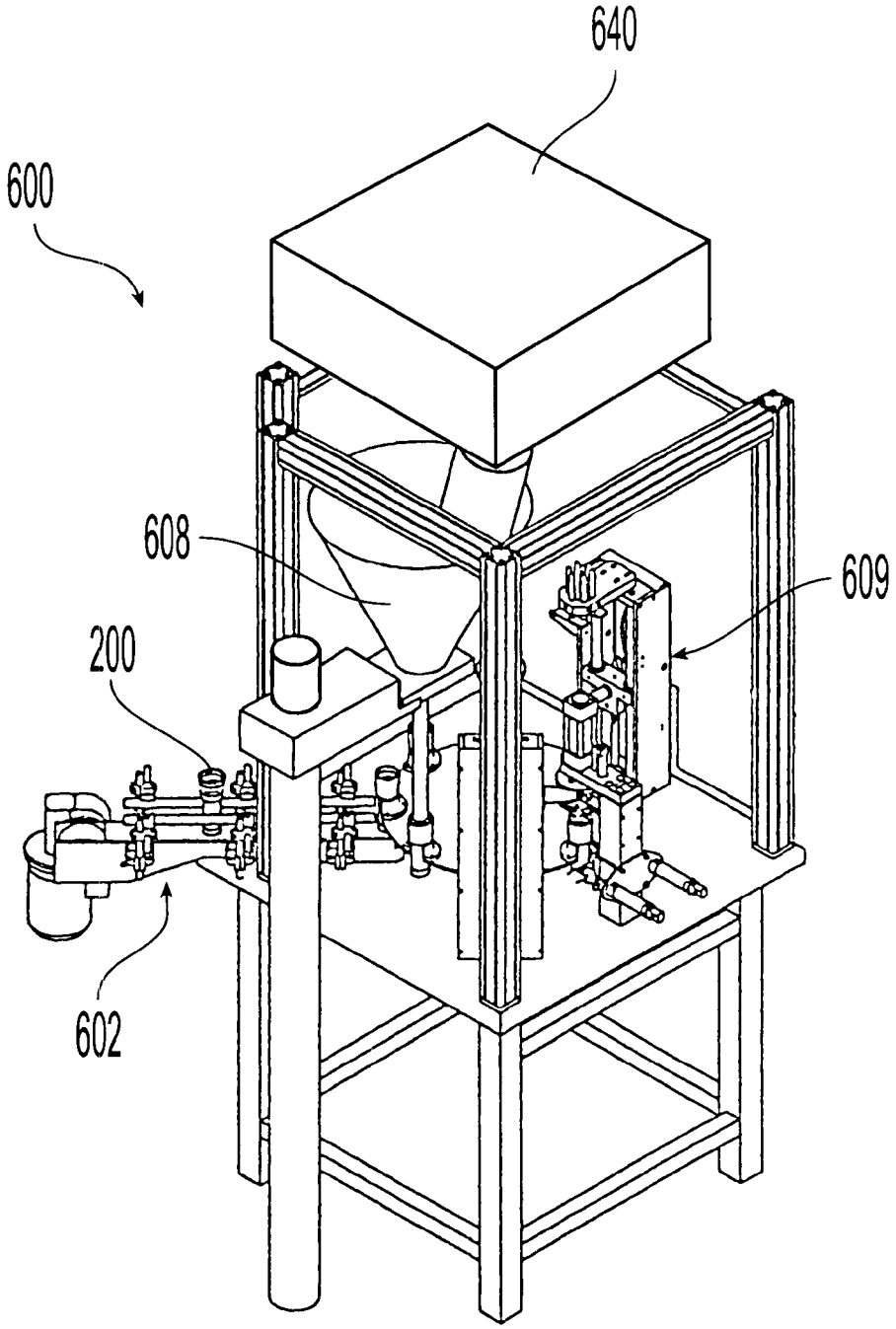
FIG. 13 is a perspective view of a powder filling station of the container filling station of FIG. 11.

FIG. 12 illustrates a perspective view of a conveyor unit 602 that is configured to transport empty bottles into powder filling station 600 while FIG. 13 illustrates a perspective view of the powder filling station 600.

Bottle 200 is first assembled so that displaceable member 218 is in its sealing position, forming two cavities, upper and lower, within main tank 250 of housing 202. The bottle is placed onto a conveyor unit 602 with lower cavity or compartment 214 oriented upwardly. Conveyor unit 602 transfers the bottle into powder filling station 600 and inserts the bottle into a bottle-holding pocket 604 of a rotating table 606. Provided along the periphery of rotating table 606 are various apparatus for performing each of the process steps associated with the powder filling process. The rotating table transports the bottle from one apparatus to another by rotating.

In a preferred embodiment of the bottle filling process, a leak test may be performed for testing the integrity of the seals between the compartments. Rotating table 606 first positions the empty baby bottle at a leak tester (not shown) for testing the integrity of the fluid-tight seal formed at neck portion 204, which, in container 200, is formed by the engagement of the annular groove 206 and the annular projection 210.

The leak testing may be accomplished by a vacuum leak testing method. For example, the leak tester may temporarily seal one of the two openings of bottle 200 by a suitable sealing means, such as an elastomeric disk made of silicone rubber coated disks and the like. This results in one of the two compartments being sealed with an elastomeric disk on one side and the fluid-tight seal at neck portion 204 formed by the engagement of the annular groove 206 and the annular projection 210, on the other side. A vacuum pump is then connected to the sealed compartment through a hole in the elastomeric disk to measure the rate at which a predetermined vacuum pressure may be reached. This measurement may be used as a criteria for determining whether the displaceable member is satisfactorily sealed. A container that does not meet the seal integrity test may be automatically marked by the leak tester and later ejected from the powder filling station without being filled.

Once the empty bottle passes the leak testing step, rotating table 606 transports the bottle to a powder filling hopper unit 608. The powder filling hopper unit dispenses a predetermined amount of the powdered baby formula into lower compartment 214 of bottle 200 through opening 229 in bottom portion 226 of the displaceable member.

An anti-electrostatic system may be utilized at this step to prevent any airborne particles of the formula from adhering to the powder dispensing spout. In a preferred embodiment, an active ionizing anti-electrostatic system utilizing a ring-type ionizing electrode is provided around the powder dispensing spout. The ionizing ring neutralizes any electrostatic charges that may be present in the powder being dispensed and prevents the powder from sticking to the dispensing spout.

Next, rotating table 606 positions the bottle at a first membrane placing unit 609. The first membrane placing unit places a membrane over opening 229 to seal lower compartment 214. Rotating table 606, then, rotates again to position the bottle at a first membrane sealing apparatus 610 for sealing the membrane over the opening 229. The membrane would be sealed to displaceable member 227 along the opening's peripheral portion 227*a*.

The membrane may be a foil or a non-metallic membrane such as a plastic or a polymer sheet that allows the sealing unit to hermetically seal the lower compartment 214. The membrane may have a single-layer structure or multi-layer laminate structure. Where the baby feeding bottle may be warmed in a microwave oven, a non-metallic membrane would be preferred.

Possible methods of sealing the membrane over the opening of the bottle are heat welding, or gluing and the seal may be applied to the opening's peripheral portion. In the case of bottle 200, a membrane would seal the opening 229 in place of the illustrated stopper 228.

Next, rotating table 606 may position the bottle at a second membrane placing unit 611. The second membrane placing unit places a membrane over an opening formed by bottom side rim 270 of the container housing 202. Rotating table 606, then, rotates again to position the bottle at a second membrane sealing apparatus 612. The second sealing apparatus seals the membrane along the bottom side rim 270.

As discussed above in reference to FIGS. 6A–6C, the second seal helps protect the inter-compartmental seal formed by displaceable member 218 and container housing 202 from being compromised, especially during an air transportation. The second membrane seal may also provide additional assurance that the first seal may not accidentally be broken. The first two membrane seals are intended to be permanent seals and as such the welded seal strength may be sufficiently high to prevent the membranes from being peeled off.

Figure 14:
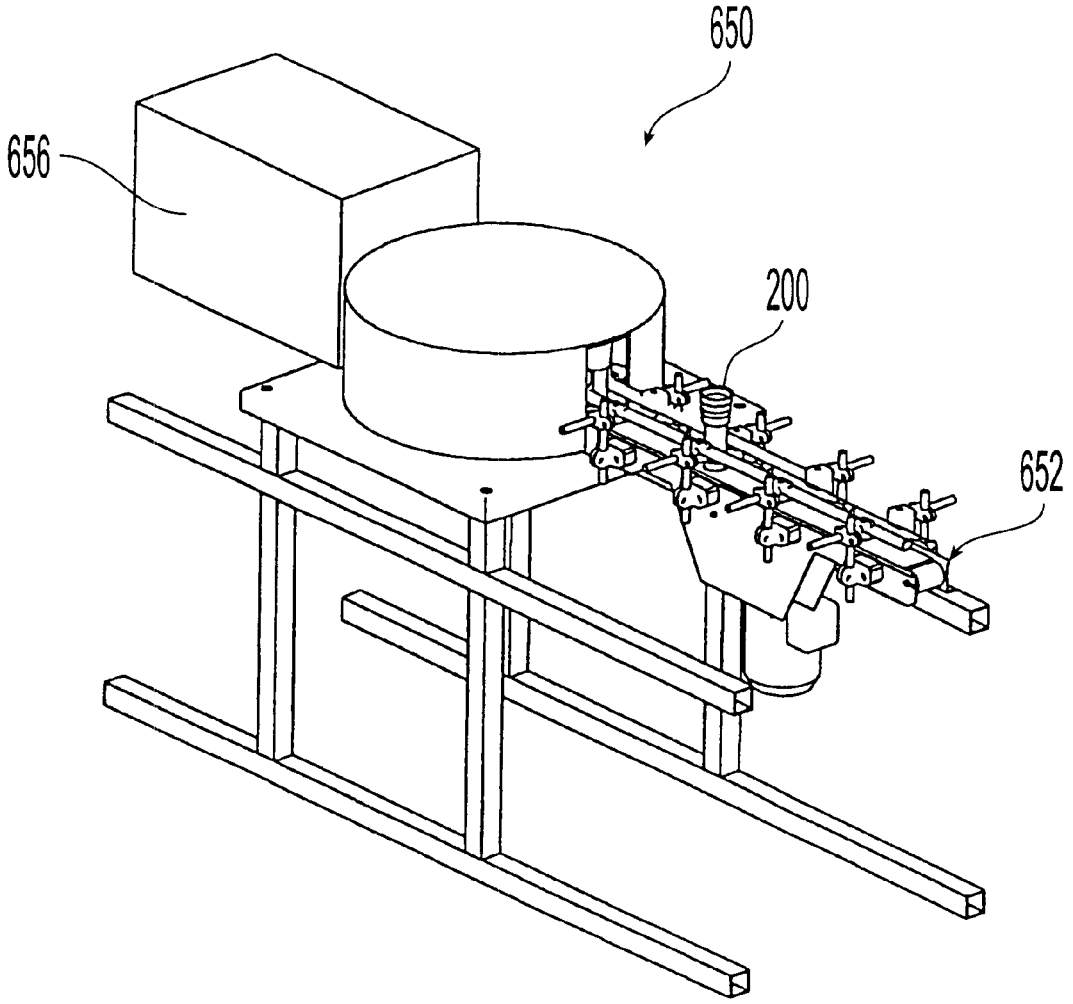
FIG. 14 is a perspective view of a separating and rotating station of container filling station of FIG. 11.

The baby feeding bottle is, then, transferred to the separating and rotating station 650 via a conveyor unit 652 that connects powder filling station 600 and separating and rotating station 650. FIG. 14 illustrates a perspective view of the separating and rotating station 650.

The separating and rotating station is placed between the powder filling station and the water filling station and is provided with a filtered laminar air flow system 660 that keeps the station at a positive air pressure relative to the two filling stations as well as the external environment. Positioning the separating and rotating station between the powder filling station and the water filling station maintains the two stations as two separate environments and prevents or minimizes any cross-contamination between the two filling stations. In filling processes where one of the materials to be stored in the container is a liquid and one is a solid particulate such as a powder, the separating and rotating station is advantageous because it separates the two filling stations so that the environmental conditions of each station can be separately controlled. Curtains may be provided between the filling stations and separating and rotating station to facilitate and maintain the separate and controlled environments and decrease cross-contamination. In the separating and rotating station, the baby feeding bottle is rotated 180° by a bottle rotating unit 656 so that the upper compartment is oriented upwardly.

Figure 15:
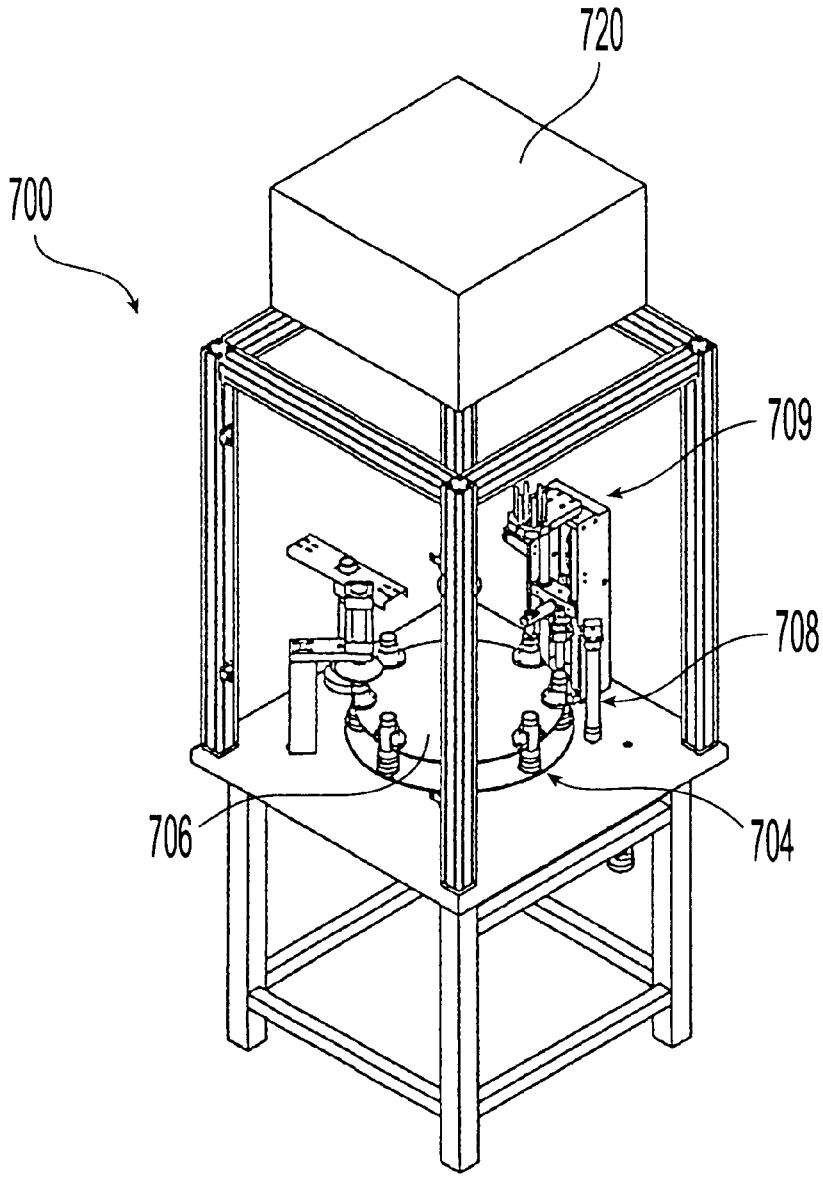
FIG. 15 is a perspective view of a liquid filling station of container filling station of FIG. 11.

The bottle is then transported into water filling station 700. FIG. 15 illustrates a perspective view of water filling station 700. The water filling station is also provided with a filtered laminar air flow unit 720 to maintain a positive air pressure within the water filling station to prevent contamination and to control the cleanliness of the environment within the station.

Upon entering the water filling station, the bottle is inserted into a bottle-holding pocket 704 of rotating table 706. The rotating table positions the bottle under a water filling apparatus 708 which fills the upper compartment of the bottle with a predetermined amount of water.

Next, rotating table 706 positions the bottle under a third membrane placing unit 709. The third membrane placing unit places a membrane over the top opening of the bottle. Rotating table 707, then, positions the bottle under a third membrane sealing apparatus 710 which seals the upper compartment by sealing the membrane against rim portion 252 of the top opening.

Unlike the membrane seals over the lower compartment, the membrane seal over the upper compartment is preferably not a permanent seal but may be peeled off to dispense the baby formula when ready for use. For example, after the contents of the bottle are mixed to form a baby formula, the user would peel off the membrane seal on top of the baby feeding bottle and attach a rubber nipple for feeding.

Upon completion of the third membrane sealing process step, the bottle is, then, transferred from rotating table 706 to a finishing conveyor 750. The basic function of the finishing conveyor is to transport the filled bottle out of the water filling station. However, the finishing conveyor may be provided with additional apparatus to perform additional finishing processes. Examples of these additional finishing apparatus are: a metal detector 752 capable of detecting ferrous and non-ferrous metals may be provided to detect any bottles with metallic particulate contaminants; a printer 754 for printing such information as expiration date and batch number on the body of the bottle; a labeling machine 756 that affixes labels on the bottle; and a continuously rotating round table carousel 758 onto which the finished bottles are ejected where visual quality inspection may be performed before the bottles are packaged for shipping. The finishing conveyor or other stations may be supplied with further leak testers to test the seals formed by the membranes which cover the container openings.

It should be appreciated that while the process of filling and preparing a two-compartment container has been shown with the powder filling station first, the apparatus can be easily configured to have the liquid filling station as the first operation station in the process. In either case, it is preferred to provide separate environments for each station and preferable to separate the two filling stations with the rotating and separating station placed between the filling stations. Either station may be provided with a nitrogen or other inert or sterile controlled environment for the filling processes.

While the process has been described as having three substations, it should be appreciated that the filling process can be achieved by a single integrated machine in which the empty containers, or more appropriately precursor containers, are introduced into the machine and a filled container exits the machine without any human intervention or transfer. Alternatively, the stations and substations can be separate machines or performed by hand. In addition, while separate air flow units have been described for each substation, it will be appreciated that only one air flow unit may be provided for all stations, or alternatively no air flow units provided depending on the degree of environmental control desired.

In cases such as infant formula in which the mixture may need to be warmed to ensure dissolution or for dispensing, the two-compartment container may be made entirely of non-metallic materials to allow direct heating of the contents in a microwave oven. Alternatively, or in addition to, the two-compartment container may be made entirely of materials to allow heating of the contents by placing the container in boiling or heated liquid such as water. Many materials may be used in the construction of the different embodiments of the invention including plastics such as, for example, polypropylene. The feeding nipple and portions of the partition wall may be made of silicon rubber. When used to store or dispense medicines and food, it is contemplated that the materials of the container meet regulatory standards such as provided by the United States Food and Drug Administration and other regulatory authorities.

It will be appreciated that the above descriptions are intended only to serve as examples, and that many other embodiments are possible and encompassed within the spirit and the scope of the present invention.

We claim:

1. A process for filling a multi-compartment container for holding at least two components in separate compartments, the process comprising:

(a) providing a housing of a container having an internal space between a top opening and a bottom opening having a partition wall between the top opening and the bottom opening separating the container into an upper compartment and a lower compartment;

(b) conveying the container using a first conveyor into a first component filling station;

(c) introducing a predetermined amount of the first component into the lower compartment through the bottom opening;

(d) sealing the lower compartment by sealing the bottom opening;

(e) conveying the container using a second conveyor into a separating and rotating station;

(f) rotating the container approximately 180° so that the top opening is an upward position;

(g) conveying the container using a third conveyor into a second compartment filling station;

(h) filling the upper compartment with a predetermined amount of the second component through the top opening; and (i) sealing the upper compartment by sealing the top opening.

2. A process according to claim 1, wherein the partition wall is integral with and forms a seal with the housing to define the upper and lower compartments.

3. A process according to claim 2, wherein the lower compartment is sealed by sealing the opening in the second end of the displaceable member.

4. A process according to claim 3, wherein the second end is sealed with a membrane.

5. A process according to claim 4, further comprising:

providing a second membrane seal at a bottom side rim of the container housing.

6. A process according to claim 1, further comprising:

fitting a displaceable member at the bottom opening of the housing such that it engages the bottom end of the container in a displaceable manner, the displaceable member having the partition wall on a first end adapted to form a fluid-tight seal, an opening in a second end, and being axially displaceable between two positions along an axis extending through the container, the two positions comprising a first sealed position in which the partition wall forms and defines at least two fluid-tight compartments, a lower compartment and an upper compartment, separated by and sharing at least a portion of the partition wall, and a second unsealed position where the partition wall is displaced permitting flow communication between the two compartments, where the fitting step places the displaceable member in the first sealing position.

7. A process according to claim 1, further comprising:

checking the integrity of the fluid-tight seal by vacuum leak testing before the first component is introduced into the lower compartment.

8. A process according to claim 1, wherein the top opening is sealed with a membrane.

9. A process according to claim 8, wherein the membrane is a multi-layered laminate.

10. A process according to claim 8, wherein the membrane is constructed from a material selected from a group comprising metallic foils, polymer coated metallic foils, non-metallic membranes, plastic and polymers.

11. A process according to claim 1, wherein components consist of at least one of the group comprising particulate solids and liquids.

12. A process according to claim 1, wherein the first component filling station; the separating and rotating station; and the second component filling station are under a positive air pressure relative to the ambient environment.

13. A process according to claim 12, wherein the separating and rotating station is under a positive air pressure relative to the first component filling station and the second component filling station.

14. A process for filling a multi-compartment container for holding at least two components in separate compartments, the process comprising:

(a) providing a housing of a container having an internal space between a top opening and a bottom opening;

(b) fitting a displaceable member at the bottom opening of the housing such that it engages the bottom end of the container in a displaceable manner, the displaceable member having a partition wall on a first end, adapted to form a fluid-tight seal, an opening in a second end, and being axially displaceable between two positions along an axis extending through the container, the two positions comprising a first sealed position in which the partition wall forms and defines at least two fluid-tight compartments, a lower compartment and an upper compartment, separated by and sharing at least a portion of the partition wall, and a second unsealed position where the partition wall is displaced permitting flow communication between the two compartments, where the fitting step places the displaceable member in the first sealed position;

(c) conveying the container using a first conveyor into a powder filling station;

(d) introducing a predetermined amount of a powder component into the lower compartment through the opening in the second end of the displaceable member;

(e) sealing the lower compartment by sealing the opening in the second end of the displaceable member;

(f) conveying the container using a second conveyor into a separating and rotating station;

(g) rotating the container approximately 180° so that the top opening is in an upward position;

(h) conveying the container using a third conveyor into a liquid filling station;

(i) filling the upper compartment with a predetermined amount of liquid through the top opening; and (j) scaling the upper compartment by sealing the top opening.

15. A process according to claim 14, further comprising:

checking the integrity of the fluid-tight seal by vacuum leak testing before the first component is introduced into the lower compartment.

16. A process according to claim 15, wherein the lower compartment is sealed by sealing the opening in the second end of the displaceable member.

17. A process according to claim 16, wherein the second end is sealed with a membrane.

18. A process according to claim 15, further comprising:

providing a second membrane seal at a bottom side rim of the container housing.

19. A process according to claim 14, wherein the top opening is sealed with a membrane.

20. A process according to claim 19, wherein the membrane is constructed from a material selected from a group comprising metallic foils, polymer coated metallic foils, non-metallic membranes, plastic and polymers.

21. A process according to claim 14, wherein the membrane is a multi-layered laminate.

22. A process according to claim 14, wherein the first component filling station; the separating and rotating station; and the second component filling station are under a positive air pressure relative to the ambient environment.

23. A process according to claim 22, wherein the separating and rotating station is under a positive air pressure relative to the first component filling station and the second component filling station.

24. A multi-compartment container filling apparatus with at least two components in separate compartments, said container having an internal space between a top opening and a bottom opening having a partition wall between the top opening and the bottom opening separating the container into an upper compartment and a lower compartment, comprising:

a first conveyor adapted and configured to convey the container into a first component filling station, the first component filling station adapted and configured to fill a predetermined amount of the first component into the lower compartment through the bottom opening and further configured to seal the bottom opening;

a second conveyor adapted and configured to convey the container into a separating and rotating station, the separating and rotating station adapted and configured to rotate the container approximately 180° so that the top opening of the container faces upward;

a third conveyor adapted and configured to convey the container into a second component filling station, the second component filling station adapted and configured to fill the upper compartment with a predetermined amount of the second component through the top opening and further configured to seal the top opening.

25. An apparatus according to claim 24, further comprising:

a first rotating table in the first component filling station provided with one or more pockets, each pocket configured to hold a container during the first component filling operation;

a second rotating table in the second component filling station provided with one or more pockets, each pocket configured to hold a container during the second component filling operation.

26. An apparatus according to claim 24, wherein the first component filling station includes a powder dispensing hopper unit, the powder dispensing hopper unit provided with an anti-electrostatic system to prevent free powder particles from adhering to the powder dispensing hopper's dispensing spout.

27. An apparatus according to claim 24, wherein at least one vacuum leak testing unit is provided for testing the integrity of a fluid-tight seal formed within the container by a displaceable member and the container's housing.

28. An apparatus according to claim 24, further comprising:

at least one membrane sealing unit for sealing the bottom and top openings with membranes.

29. An apparatus according to claim 28, wherein the membrane is constructed from a material selected from a group comprising metallic foils, polymer coated metallic foils, non-metallic membranes, plastic and polymers.

* * * * *